US009468301B2

(12) United States Patent
Rivera

(10) Patent No.: US 9,468,301 B2
(45) Date of Patent: Oct. 18, 2016

(54) SEATING WITH ADJUSTABLE CUSHIONS

(71) Applicant: TROPITONE FURNITURE CO., INC., Irvine, CA (US)

(72) Inventor: Richard Rivera, Corona, CA (US)

(73) Assignee: TROPITONE FURNITURE CO., INC., Irvine, CA (US)

( * ) Notice: Subject to any disclaimer, the term of this patent is extended or adjusted under 35 U.S.C. 154(b) by 53 days.

(21) Appl. No.: 14/265,163

(22) Filed: Apr. 29, 2014

(65) Prior Publication Data

US 2014/0319890 A1 Oct. 30, 2014

Related U.S. Application Data

(60) Provisional application No. 61/817,822, filed on Apr. 30, 2013, provisional application No. 61/981,382, filed on Apr. 18, 2014.

(51) Int. Cl.
*A47C 7/18* (2006.01)
*A47C 7/20* (2006.01)
(Continued)

(52) U.S. Cl.
CPC ..... *A47C 7/467* (2013.01); *A47C 4/54* (2013.01); *A47C 7/18* (2013.01); *A47C 7/38* (2013.01); *A47C 27/088* (2013.01); *A47C 7/021* (2013.01); *A47C 7/022* (2013.01)

(58) Field of Classification Search
CPC ..... A47C 7/18; A47C 7/185; A47C 7/20; A47C 7/02; A47C 7/021; A47C 7/022; B60N 2/02; B60N 2/16; B60N 2/4805; B60N 2/64
USPC ..... 297/180.11, 180.1, 195.1, 196, 214, 297/219.1
See application file for complete search history.

(56) References Cited

U.S. PATENT DOCUMENTS 3,661,422 A 5/1972 Sember et al.
3,974,827 A * 8/1976 Bodeen ..... A47C 7/467 128/DIG. 20

(Continued)

FOREIGN PATENT DOCUMENTS

DE 1011213 6/1957
DE 4211895 10/1993

(Continued)

OTHER PUBLICATIONS

"Mainstream Commercial Pressure Relief Valves", Raft repair leafield engineering Halkey Roberts, Copyright 2004, http://www.raftrepair.com/relief_valve.php, viewed Feb. 19, 2014.

(Continued)

*Primary Examiner* — Phi A
(74) *Attorney, Agent, or Firm* — Knobbe, Martens, Olson & Bear, LLP

(57) ABSTRACT

A seating, including a sling seating, can have adjustable and/or non-adjustable cushions. An occupant of the seating can adjust the thickness and support provided by an adjustable cushion. The adjustable cushion can include an open cell foam in an airtight envelope. The occupant can open a control valve connected to the envelope to let air out of the airtight envelope while the occupant applies external pressure to the open cell foam, which decreases the thickness of the adjustable cushion as the open cell foam compresses. The occupant can close the valve to restrict airflow into and out of the envelope at a desired thickness of the adjustable cushion. The occupant can subsequently open the valve to let air into the envelope while the occupant does not apply external pressure to the open cell foam, which increases the thickness of the adjustable cushion as the open cell foam expands.

12 Claims, 25 Drawing Sheets

(51) Int. Cl.

| | |
|---|---|
| ***A47C 7/02*** | (2006.01) |
| ***A47C 7/46*** | (2006.01) |
| ***A47C 27/08*** | (2006.01) |
| ***A47C 4/54*** | (2006.01) |
| ***A47C 7/38*** | (2006.01) |

(56) References Cited

U.S. PATENT DOCUMENTS

| | | | | |
|---|---|---|---|---|
| 4,108,492 | A * | 8/1978 | Kirby | A47C 7/021 297/284.3 |
| 4,589,695 | A * | 5/1986 | Isono | A47C 7/022 297/284.11 |
| 4,725,094 | A * | 2/1988 | Greer | A47C 31/02 297/188.06 |
| 4,914,836 | A * | 4/1990 | Horovitz | A43B 13/206 139/384 R |
| 4,960,304 | A * | 10/1990 | Frantz | A47C 7/021 297/284.6 |
| 5,052,068 | A * | 10/1991 | Graebe | A47C 7/021 297/452.23 |
| 5,282,286 | A | 2/1994 | MacLeish | |
| 5,318,348 | A * | 6/1994 | Hess | A47C 31/023 297/440.11 |
| 5,660,438 | A | 8/1997 | Tedesco | |
| 5,882,083 | A * | 3/1999 | Robinson | A47C 1/0342 297/118 |
| 5,979,975 | A * | 11/1999 | Hiraoka | A47C 7/748 297/180.11 |
| 6,007,091 | A * | 12/1999 | Westrich | B60R 21/207 280/728.3 |
| 6,135,550 | A | 10/2000 | Tucho | |
| 6,682,145 | B2 | 1/2004 | Wilkerson et al. | |
| 6,684,433 | B2 | 2/2004 | Giori et al. | |
| 6,830,293 | B2 * | 12/2004 | Vanderminden | A47C 31/00 297/219.1 |
| 7,588,115 | B2 * | 9/2009 | Breed | B60N 2/0232 180/271 |
| 7,685,664 | B2 * | 3/2010 | Stolpmann | A47C 27/081 5/680 |
| 8,864,221 | B1 * | 10/2014 | Delvilla | A47C 7/62 297/180.11 |
| 9,314,118 | B2 * | 4/2016 | Blazar | A47G 9/1027 |
| 2002/0116766 | A1 * | 8/2002 | Stolpmann | A47C 27/084 5/710 |
| 2003/0001416 | A1 * | 1/2003 | Vanderminden | A47C 31/00 297/219.1 |
| 2003/0208848 | A1 * | 11/2003 | Flick | A47C 27/082 5/713 |
| 2005/0046266 | A1 | 3/2005 | Schiebl | |
| 2006/0279074 | A1 * | 12/2006 | Tracht | B60R 21/215 280/730.2 |
| 2013/0019409 | A1 * | 1/2013 | Blazar | A47G 9/1027 5/644 |
| 2015/0113735 | A1 * | 4/2015 | Anderson | A47C 7/021 5/654 |

FOREIGN PATENT DOCUMENTS

| | | |
|---|---|---|
| EP | 2006151 | 12/2008 |
| GB | 1299789 | 12/1972 |
| WO | WO 0232272 | 4/2002 |

OTHER PUBLICATIONS

"FAQ, tips and tricks about inflatable boats", BoatsToGo.com, http://www.boatstogo.com/faq.asp, viewed Feb. 19, 2014.

"Halkey Roberts Inflatable Boat Valve (Part #69ONSBV)", InflatableBoatParts.com, http://shop.inflatableboatparts.com/product.php?productid=280, viewed Feb. 19, 2014.

"Isolation Valves—Linear Movement", International site for Spirax Sarco Limited, http://www.spiraxsarco.com/resources/steam-engineering-tutorials/pipeline-ancillaries/isolation-valves-linear-movement.asp, viewed Feb. 13, 2014.

"Diaphargm Valve in BioProcess Engineering", Diaphargm Valve in BioProcess Engineering—Desmech.com, http://www.desmech.com/?p=3, viewed Feb. 13, 2014.

"New Weldon fuel-pressure regulator for carbureted applications", http://www.mooregoodink.com/new-weldon-fuel-pressure-regulator-for-carbureted-applications/, viewed Feb. 13, 2014.

"Poppet valve", Wikipedia, http://en.wikipedia.org/wiki/Poppet_valve, viewed Feb. 13, 2014.

"Push Button Momentary Valve, 3 Way, No, Black", 2014 surgicaltoolds.com, https://www.surgicaltools.com/30206/push-button-momentary-valve-3-way-no-back/, viewed Feb. 13, 2014.

"Solenoid Valve Basics", solenoid-valve-info.com, http://www.solenoid-valve-info.com/solenoid-valve-basics.html, viewed Feb. 13, 2014.

"Solenoid Valve", Wikipedia, http://en.wikipedia.org/wiki/Solenoid_valve, viewed Feb. 13, 2014.

* cited by examiner

SEATING WITH ADJUSTABLE CUSHIONS

INCORPORATION BY REFERENCE TO ANY PRIORITY APPLICATIONS

Any and all applications for which a foreign or domestic priority claim is identified in the Application Data Sheet as filed with the present application are incorporated by reference and made a part of this specification.

BACKGROUND

1. Field

The present application generally relates to adjustable seating, and more particularly to adjustable cushions for seating.

2. Description of the Related Art

Seating has been known for many years. Conventional seating does not have a contour or support which will fit all persons, even where the seating has features that allow for changing different body angles or seating postures through the use of a variety of seat supports or cushions. Persons who desire to sit in a seating for an extended period of time may experience discomfort and even tissue injury.

SUMMARY

There is a need for a seating with adjustable cushions for comfort as well as aesthetic, safe, and reliable valves for adjusting the cushions. When a person is seated for a relatively long period of time, there is a desire to obtain a different seating posture and/or a varying level of cushioning. An adjustable seating cushion can provide desired comfort over an extended period of time. The adjustable cushion can be positioned anywhere on the seating such as, for example, the lumbar section of the seating. The seating can be a chair, chaise, sofa or the like. The adjustable cushion can include an open cell foam material encased in an airtight envelope. The open cell foam material can be self-resilient and springy so to return to its original shape when no pressure or little pressure is applied on the foam material, in particular when someone is not sitting on or lying against the cushion or other support. The airtight envelope can be connected to an air control valve, such as a push button valve. When the adjustable cushion thickness and/or support is greater than desired by the seating occupant, the occupant can push with the occupants body or parts of the body against the adjustable cushion while at the same opening the valve (e.g., pushing the push button) to let air out of the encased open cell foam and compress the open cell foam. When the adjustable cushion has reached a desired thickness and/or firmness, the occupant can let the valve close (e.g., releasing the push button) to maintain the desired thickness and/or firmness with a partial vacuum created in the airtight envelope. Conversely, if the occupant wishes to have a greater thickness and/or a more full support, the occupant can temporarily remove the body weight or pressure off the adjustable cushion while opening the valve (e.g., pushing the push button) to let the partial vacuum of the open cell foam pull in ambient air into the airtight envelope. When the occupant closes the valve again, the adjustable cushion can remain at the desired thickness until the occupant wishes to further change the thickness and/or firmness of the adjustable cushion.

The adjustable cushion can have a curved contour (convex surface) facing the occupant to provide the desired body support, such as, for example, back support. Back support can include lumbar support in a backrest of the seating for engaging an occupant's lumbar region. The lumbar support can include an airtight envelope or pouch in the seating backrest and open cell foam completely disposed within the airtight envelope. The envelope can be positioned approximately complementary to a person's lumbar region. The envelope or pouch can be located within the backrest of the seating. A similar adjustable cushion support can be positioned in other regions of the seating. Thus, a personalized amount of back and/or other body support can be achieved and easily adjusted while using (sitting) in the seating. A plurality of such adjustable envelopes or pouches can be located in the seating, for example in the back rest, such as one above the other. In such a manner, the adjustable envelopes or pouches can be located over all or substantially all of the height of the backrest. Adjustable cushions minimize fatigue and maximize comfort. Specific levels of lumbar, back, and/or other body support can be selected through the operation of the air valve that controls the air flow in and out of the airtight envelope.

The internally interconnected open cells of the foam in the airtight envelope allow airflow between and through the cells throughout the foam material as well as to the exterior of the foam such that foam material expands to fill the envelope. The airflow between and through the cells allows the airtight envelope to fill with air as well as to permit the release of air when pressure is exerted on the adjustable cushion at the same time the air control valve is opened. The adjustable cushion can utilize a combination of various foams, including closed-cell foams where the individual cells are sealed and gas (e.g., air) cannot flow within the foam, to achieve a desired look, feel, and function of the adjustable cushion. The described open cell foam and airtight envelope combination is pressure-responsive to human body weight to allow air flow into and out of the envelope to quickly and easily provide various degrees of thickness and/or firmness without external pressurizing devices, such as an air pump.

The adjustable cushions, envelopes or pouches, and their features and/or manner of use described herein can be used in outdoor furniture. The components of the adjustable cushions, including the air valve as discussed herein, can be weather proofed (e.g., water resistant or waterproof) for extended outdoor use. For example they can be used in sling or so called deep cushion seating. Sling seating comprises a metal, typically aluminum, contoured frame between which fabric is stretched.

Deep cushion seating comprises a metal, typically aluminum, frame which supports cushions in predetermined positions. The cushions can be attached to the frame of the deep cushion seating. In some embodiments, the frame of the deep seating cushion can provide a support or casing (e.g., cover, envelope) that holds the deep seating cushions in the predetermined positions when the deep seat cushions are removably placed onto the frame. Deep seat cushions can comprise foams or other support media as discussed herein wrapped in fabric or other suitable encasing materials to provide padding or cushioning when an occupant sits in the deep cushion seating.

In particular, they can be used in the backrest of such seating. For example, the backrest can comprise a rear fabric layer, a stiffening layer, such as a relatively inflexible plastics material, at least one optional foam layer, at least one such adjustable envelope or pouch and a front fabric layer. The rear fabric layer can be stretched between a metal frame, such as in the manner of a sling.

The seating can employ a low profile valve that can selectively control fluid (e.g., air) flow into and out of an inflatable object (e.g., adjustable cushioning and/or airtight envelope). The low profile valve can be connected to the inflatable object via a tube or directly to the inflatable object. The low profile valve can be connected to and/or engage an exterior material of the inflatable object. The valve can be flush or substantially flush with the exterior of the inflatable object. The valve can have a low profile so as to be aesthetically appealing (e.g., being flush with the inflatable object). The valve can have a low profile to avoid or mitigate damage to the valve by snagging other objects that come in contact with the valve or inflatable object. The valve can have a low profile to improve safety during use of the inflatable object, such as for example, mitigating snagging of clothing or body parts of a user during use of the inflatable object and/or the valve.

In accordance with embodiments disclosed herein, seating with at least one adjustable cushion is provided. The seating can comprise a backrest comprising a backrest frame and a backrest sling fabric, the backrest frame having a left side and a right side opposite the left side, the backrest sling fabric having a left side and a right side opposite the left side, the backrest sling fabric supported at the left and right sides of the backrest sling fabric by the left and right sides of the backrest frame, respectively, suspending the backrest sling fabric between the left and right sides of the backrest frame. The seating can further comprise a seat connected to the backrest, the seat comprising a seat frame and a seat sling fabric, the seat frame having a left side and a right side opposite the left side, the seat sling fabric having a left side and a right side opposite the left side, the seat sling fabric supported at the left and right sides of the seat sling fabric by the left and right sides of the seat frame, respectively, suspending the seat sling fabric between the left and right sides of the seat frame. The seating can further comprise at least one adjustable cushion on at least one of the backrest sling fabric or the seat sling fabric, the adjustable cushion comprising an airtight envelope, compressible foam inside the envelope, support foam outside the envelope, and a substantially rigid backing member, the airtight envelope comprising at least one port providing fluid communication to an interior of the envelope, wherein the backing member rests against the backrest sling fabric or the seat sling fabric, the support foam rests against the backing member, and the airtight envelope rests against the support foam, and wherein the backing member biases the support foam away from the backrest sling fabric or the seat sling fabric, and the support foam biases the compressible foam away from the backrest sling fabric or the seat sling fabric. The seating can further comprise a valve in fluid communication with the port of the envelope, the valve configured to selectively allow ambient air to pass into and out of the airtight envelope, via the port, through the valve. Firmness of the adjustable cushion can be decreased by opening the valve to allow air to flow out of the airtight envelope and the compressible foam as the compressible foam compresses within the airtight envelope when external pressure is applied to the airtight envelope. Firmness of the adjustable cushion can be increased by opening the valve to allow ambient air to flow into the airtight envelope and the compressible foam when the compressible foam is in a compressed state and expands within the airtight envelope while ambient air flows into the airtight envelope.

In some embodiments, the at least one adjustable cushion is on or part of a backrest comprising sling fabric; the at least one adjustable cushion is positioned in at least one of a lumbar region of the backrest or a head region of the backrest; a first adjustable cushion is positioned in the lumbar region and a second adjustable cushion is positioned in the head region; the at least one adjustable cushion is on the seat sling fabric; the backing member comprises a flat panel having about same dimensions as the adjustable cushion to generally maintain a flat shape of the backrest sling fabric or the seat sling fabric as the firmness of the adjustable cushion is changed; the backing member further comprises at least one rounded side attached to the flat panel to form a corresponding rounded side in the backrest sling fabric or the seat sling fabric; the compressible foam has a size and the support foam has a size and wherein the compressible foam is about half in size of the support foam; a density of the support foam varies depending at least on a size of the compressible foam; the density of the support foam increases as the size of the compressible foam decreases; the valve comprises a push button configured to allow ambient air to pass through the valve when the push button is depressed; the push button of the valve is substantially flush with an exposed surface of the adjustable cushion; the valve comprises a twist cap configured to allow ambient air to pass through the valve into the airtight envelope when the twist cap is turned in a first direction; the seat further comprises an armrest connected to at least one of the backrest frame or the seat frame, and wherein the valve is positioned in or on the armrest; the seating further comprising a tube connected to the port of the airtight envelope and the valve to provide fluid communication between the airtight envelope and the valve; the seating further comprising at least one non-adjustable cushion on at least one of the backrest sling fabric or the seat sling fabric, wherein substantially an entire seating area defined by the backrest and the seat is generally defined by at least one of the adjustable cushion or the non-adjustable cushion; the backrest is movable with respect to the seat; the backrest is at an angle to the seat when not in use, and wherein the seating is configured such that the weight of a user on the backrest causes that angle to increase, and when the user gets off the seating, the backrest returns to said angle; the adjustable cushion and the valve are water resistant for outdoor use; the backrest frame or the seat frame comprises a sling channel, and the adjustable cushion comprises a sling rail, and wherein the sling channel is configured to engage the sling rail to suspend the backrest sling fabric or the seat sling fabric; the backrest sling fabric or the seat sling fabric is suspended and drawn taut substantially via the engagement of the sling rail by the sling channel; the sling rail of the adjustable cushion is formed by wrapping and securing ends of the backrest sling fabric or the seat sling fabric around a rod along a height of the backrest sling fabric or the seat sling fabric; the backing member is not connected to or resting on the backrest frame or the seat frame of the seating; the at least one adjustable cushion includes a first adjustable cushion and a second adjustable cushion, the first adjustable cushion positioned in a top region of the backrest, and the second adjustable cushion positioned in a bottom region of the backrest; the seating further comprises at least one non-adjustable cushion positioned in a middle region of the backrest, wherein the middle region is between the top and bottom regions of the backrest; the first adjustable cushion, the second adjustable cushion, and the non-adjustable cushion substantially cover an entire back area defined by the backrest of the seating; and/or the adjustable cushion is on the seat sling fabric and positioned against a side of a leg of an occupant to directionally support and bias the leg along a length of the seat.

In accordance with embodiments disclosed herein, an adjustable cushion assembly for seating is provided. The adjustable cushion assembly can comprise an enclosure comprising an opening, the enclosure configured to inhibit ambient air from passing into and out of the enclosure except through the opening. The adjustable cushion assembly can further comprise a first foam in the enclosure. The adjustable cushion assembly can further comprise a second foam positioned behind the enclosure. The adjustable cushion assembly can further comprise a backing positioned behind the second foam, the backing on a fabric of the seating and suspended on a frame of the seating. The adjustable cushion assembly can further comprise a valve in fluid communication with the enclosure via the opening of the enclosure, the valve configured to selectively allow ambient air to pass into and out of the enclosure, via the opening, through the valve. Firmness of the adjustable cushion assembly is decreased by opening the valve to allow air to flow out of the enclosure when the first foam is compressed within the enclosure while external pressure is applied to the enclosure. Firmness of the adjustable cushion assembly is increased by opening the valve to allow ambient air to flow into the enclosure when the first foam is in a compressed condition and as the first foam expands within the enclosure.

In some embodiments, the adjustable cushion assembly and the valve are water resistant for outdoor use; the first foam is about half in size of the second foam; a density of the second foam varies depending at least on a size of the first foam; the density of the second foam increases as the size of the first foam decreases; arrangement of the second foam behind the first foam and the backing behind second foam forms a shape of the adjustable cushion assembly that is generally convex at the first foam and generally flat at the backing; the valve comprises a push button configured to allow ambient air to pass through the valve when the push button is depressed; the adjustable cushion assembly further comprising a tube connected to the opening of the enclosure and the valve to provide fluid communication between the enclosure and the valve; and/or the backing is not connected to or resting on the frame of the seating.

In accordance with embodiments disclosed herein, an adjustable cushion assembly for seating is provided. The adjustable cushion assembly can comprise an enclosure comprising an opening for air to flow into and out of the enclosure. The adjustable cushion assembly can further comprise a first foam in the enclosure. The adjustable cushion assembly can further comprise a second foam at least partially behind the enclosure. The adjustable cushion assembly can further comprise a support member at least partially behind the second foam, the support member adjacent to fabric of the seating. Firmness of the adjustable cushion assembly can be decreased by flow of air out of the enclosure when the first foam is compressed within the enclosure. Firmness of the adjustable cushion assembly can be increased by flow of air into the enclosure when the first foam is in a compressed condition and as the first foam expands within the enclosure.

In some embodiments, a density of the second foam varies depending at least on a size of the first foam; and/or arrangement of the second foam at least partially behind the first foam and the support member at least partially behind second foam forms a shape of the adjustable cushion assembly that is generally convex at the first foam and generally flat at the support member.

In accordance with embodiments disclosed herein, seating with adjustable cushions is provided. The seating can comprise a backrest comprising a backrest frame and a backrest fabric, the backrest frame having a left side and a right side opposite the left side, the backrest fabric having a left side and a right side opposite the left side, the backrest fabric supported at the left and right sides of the backrest fabric by the left and right sides of the backrest frame, respectively, suspending the backrest fabric between the left and right sides of the backrest frame. The seating can further comprise a seat connected to the backrest, the seat comprising a seat frame and a seat fabric, the seat frame having a left side and a right side opposite the left side, the seat fabric having a left side and a right side opposite the left side, the seat fabric supported at the left and right sides of the seat fabric by the left and right sides of the seat frame, respectively, suspending the seat fabric between the left and right sides of the seat frame. The seating can further comprise a first adjustable cushion adjacent to the backrest fabric, the first adjustable cushion positioned at an upper head portion of the backrest distal to the seat, wherein firmness of the first adjustable cushion is adjustable. The seating can further comprise a second adjustable cushion adjacent to the backrest fabric, the second adjustable cushion positioned at a lumbar portion of the backrest proximal to the seat, wherein firmness of the second adjustable cushion is adjustable. The seating can further comprise a third cushion adjacent to the backrest fabric, the third cushion positioned at a back portion of the backrest between the upper head portion and the lumbar portion of the backrest.

In some embodiments, the first, second, and third cushions substantially cover an entire area of the backrest; the first cushion substantially spans an entire length of the backrest, the length of the backrest substantially parallel to a resting surface that the seating is configured to rest on; the second cushion substantially spans an entire length of the backrest, the length of the backrest substantially parallel to a resting surface that the seating is configured to rest on; the third cushion substantially spans an entire length of the backrest, the length of the backrest substantially parallel to a resting surface that the seating is configured to rest on; firmness of the third cushion is not adjustable; a thickness of the first cushion is less than a thickness of the second cushion; the thickness of the first cushion is about three-quarters the thickness of the second cushion; a thickness of the third cushion is less than a thickness of the first cushion; a thickness of the third cushion is less than a thickness of the second cushion; the seating can further comprise a first zipper on the backrest fabric configured to provide access to an inside of the first adjustable cushion; the seating can further comprise a second zipper on the backrest fabric configured to provide access to an inside of the second adjustable cushion; the backrest fabric is formed from a single sheet of material; a front face of the first cushion, a front face of the second cushion, and a front face of the third cushion are formed from a single sheet of material, the front faces of the first, second, and third cushions facing an inside of the seating used for sitting in the seating; the front faces of the first, second, and third cushions are formed from the single sheet of material via stitching and/or connections between the single sheet of material and the backrest fabric; the seating can further comprise a fourth cushion and a fifth cushion, the fourth and fifth cushions adjacent to the seat fabric, the fourth cushion positioned proximal to the backrest on the seat, and the fifth cushion positioned distal to the backrest on the seat; firmness of the fourth cushion is not adjustable; firmness of the fifth cushion is not adjustable; the seat fabric is formed from a single sheet of material; a front face of the fourth cushion and a front face of the fifth cushion are formed from a single sheet of material, the front faces of the fourth and fifth cushions facing an inside of the seating used for sitting in the seating; the fourth and fifth cushions are formed form the single sheet of material via stitching and/or connections between the single sheet of material and the seat fabric; the fourth and fifth cushions substantially cover an entire area of the seat; the fourth cushion substantially spans an entire length of the seat, the length of the seat substantially parallel to a resting surface that the seating is configured to rest on; and/or the fifth cushion substantially spans an entire length of the seat, the length of the seat substantially parallel to a resting surface the seating is configured to rest on.

In accordance with embodiments disclosed herein, an air valve for selectively controlling flow of air is provided. The air valve can comprise a bottom comprising a nozzle, a bottom base, a bottom boss, and an air passageway, the nozzle connected to the bottom base along a central axis of the air valve, the bottom boss connected to the bottom base along the central axis, the air passageway extending along the central axis through the nozzle into the bottom boss. The air valve can further comprise a spring positioned on the bottom base, the spring at least partially circumscribing the bottom boss about the central axis when the spring is resting against the bottom base. The air valve can further comprise a plug comprising a plug flange, an actuator, and a plug boss, the plug flange circumscribing the spring about the central axis, the plug boss positioning the spring along the central axis, wherein a periphery of the plug flange is sized to move within a bottom cavity of the bottom when the plug is moved along the central axis, the bottom cavity being in fluid communication with the air passageway. The air valve can further comprise a top comprising a top flange, a top base, a top boss, and a top cavity, the top flange circumscribing the top base about the central axis, the top boss connected to the top base and extending along the central axis, the top cavity sized to at least partially enclose the bottom and the plug, the top boss comprising a top boss opening sized to circumscribe a periphery of the plug. The plug can be configured to move within at least one of the bottom cavity or the top cavity along the central axis with the actuator configured to move in the top boss opening along the central axis. The spring can bias the plug in a first direction along the central axis to form a first airtight seal between the plug and the top by the plug flange being biased against the top base. When the first airtight seal is formed by the plug flange being biased against the top base, flow of air can be inhibited between the top boss opening and the air passageway. When the first airtight seal is not formed by moving the plug along the central axis in a second direction opposite the first direction to move the plug flange away from the top base, air is capable of flowing between the top boss opening and the air passageway, wherein when air flows generally in the second direction from the top boss opening to the air passageway, air can flow first past the plug flange and then past the spring. A contact surface between the spring and the bottom base can be downstream of the plug flange along the second direction. The plug boss may not extend along the central axis past the contact surface.

In some embodiments, the air valve is configured to selectively allow air to flow into and out of an inflatable object connected to the valve via the nozzle by moving the plug along the central axis; the air valve comprises a cap comprising a cap flange, a cap base, and a cap boss, the top flange circumscribing the cap base about the central axis, the cap boss connected to the cap base and extending along the central axis, the cap base comprising a cap base cavity sized to at least partially enclose the top, wherein the cap and the top are connected to each other in fixed positions relative to each other along the central axis to form a channel between the top flange and the cap flange, the channel configured to engage a material of a casing housing the inflatable object to position the air valve in a predetermined position relative to the inflatable object; the top boss and the cap boss are correspondingly threaded to turn the top and cap relative to each other to tighten the top and the cap to each other along the central axis, wherein the cap is rotated relative to the top to reduce a dimension of the channel along the central axis and clamp down on the material of the inflatable object to position the air valve in the predetermined position relative to the inflatable object; the material in engagement with the channel of the air valve forms at least a part of an exterior of the casing housing the inflatable object; the material in engagement with the channel of the air valve is inside the casing housing the inflatable objection, and wherein the valve is enclosed by the casing; the top boss is substantially flush with the actuator along a plane perpendicular to the central axis when the spring biases the plug against the top; the air valve further comprises a first gasket positioned between the plug and the top, the second gasket at least partially forming the first airtight seal when the plug is against the top; the plug flange comprises a first groove about the central axis, and the top base comprises a second groove corresponding to the second groove about the central axis, and wherein the second gasket is positioned in the first groove or the second groove; the bottom and the top are connected to each other in fixed positions relative to each other along the central axis to form a second airtight seal between the bottom and the top; the bottom further comprises one or more projections connected to the bottom base and extending radially outward from the central axis, wherein the top comprises a duct formed from a rail connected to the top base about the central axis and extending radially inward toward the central axis, the rail having one or more cutouts configured to receive the one or more projections therethrough, wherein when the one or more projections are received through the one or more cutouts, the bottom is rotated about the central axis to move the one or more projections into the duct to connect the bottom and the top to each other in fixed positions relative to each other along the central axis to form the second airtight seal between the bottom and the top; the valve further comprises a second gasket positioned between the bottom and the top, the second gasket at least partially forming the second airtight seal; the top base comprises a third groove corresponding to a periphery of the bottom about the central axis, the second gasket positioned in the third groove; and/or the air valve is configured to selectively allow air to flow into and out of an inflatable object connected to the valve via the nozzle, wherein the nozzle comprises one or more rings on an exterior surface of the nozzle, and wherein the inflatable object comprises an airtight envelope having a tube directing air flow into and out of the airtight envelope, the tube connected to the nozzle over the exterior surface of the nozzle with the one or more rings engaging the tube to maintain a position of the tube over the exterior surface of the nozzle to form a third airtight seal.

In accordance with embodiments disclosed herein, an air valve for selectively controlling flow of air is provided. The air valve can comprise a body comprising an air passageway. The air valve can further comprise a disc comprising an actuator, wherein a periphery of the disc is sized to move within a body cavity of the body when the disc is moved along a central axis of the air valve, the body cavity in fluid communication with the air passageway. The air valve can further comprise a spring positioned along the central axis between the body and the disc within the body cavity, the spring biasing the disc in a first direction along the central axis. The air valve can further comprise a hub comprising a hub cavity sized to at least partially enclose the body and the disc. The disc can be configured to move within at least one of the body cavity and the hub cavity along the central axis. By the spring biasing the disc in the first direction along the central axis, the disc can be biased against the hub to form a first airtight seal between the disc and the hub at a seal contact surface of the disc. When the first airtight seal is formed by the disc being biased against the hub, flow of air may be inhibited between the hub opening and the air passageway. When the disc is moved along the central axis in a second direction opposite the first direction to move the disc away from the hub, air is capable of flowing between the hub opening and the air passageway. When air flows generally in the second direction from the hub opening to the air passageway, air can flow first past the seal contact surface and then past the spring.

In some embodiments, a first spring contact surface between the spring and the body is downstream of the seal contact surface along the second direction; the disc comprises a disc boss, the disc engaging the spring at a second spring contact surface with the disc boss positioning the spring along the central axis, wherein the disc boss does not extend along the central axis past the first spring contact surface; the body comprises a body boss centered on the central axis, the spring positioned about the body boss, wherein the disc boss does not extend past the body boss; the body and the hub are connected to each other in fixed positions relative to each other along the central axis to form a second airtight seal between the body and the hub; wherein the hub comprises a first gasket groove, and the disc comprises a second gasket groove, and wherein the seal contact surface comprises a first gasket positioned in the second gasket groove, the first gasket engaging the first and second gasket grooves when the disc is biased against the hub to form the first airtight seal; the body further comprises a fin connected to a periphery of the body and extending radially outward from the central axis, wherein the hub comprises a conduit formed from a rail connected to the hub about the central axis and extending radially inward toward the central axis, the rail having a cutout configured to receive the fin therethrough, wherein when the fin is received through the cutout, the body is rotated about the central axis to move the fin into the conduit to connect the body and the hub to each other in fixed positions relative to each other along the central axis; the air valve is configured to selectively allow air to flow into and out of an inflatable object connected to the air valve via the air passageway; the air valve comprises a nut comprising a nut flange circumscribing the nut about the central axis, wherein the nut and the hub are connected to each other in fixed positions relative to each other along the central axis to form a duct between the hub and the nut, the duct configured to engage a material of the inflatable object to position the air valve in a predetermined position relative to the inflatable object; a cover housing the inflatable object comprises the material in engagement with the duct of the air valve, the material forming at least a part of an exterior of the cover; and/or the material in engagement with the duct of the air valve is inside a cover housing the inflatable objection, and wherein the air valve is inside the cover.

In accordance with embodiments disclosed herein, a valve assembly for selectively controlling fluid flow is provided. The valve assembly can comprise a base comprising a fluid passageway. The valve assembly can further comprise a cover comprising a cover opening, the cover configured to connect to the base to form a fluid chamber between the base and the cover. The valve assembly can further comprise a plug configured to move in the fluid chamber along a central axis of the valve assembly. The valve assembly can further comprise a resilient member configured to be positioned in the fluid chamber to bias the plug along the central axis in a first direction against the cover when the base and the cover are connected and the plug is positioned in the fluid chamber. When the resilient member biases the plug in the first direction along the central axis against the cover, the plug and the cover can form a first seal at a seal contact surface of the plug or the cover to inhibit fluid flow between the cover opening and the fluid passageway. With the base and the cover connected and the plug and the resilient member positioned in the fluid chamber, when the plug is moved along the central axis in a second direction opposite the first direction to move the plug in the fluid chamber away from the cover, fluid is capable of flowing between the cover opening and the fluid passageway through the fluid chamber. When fluid flows generally in the second direction from the hub opening to the fluid passageway through the fluid chamber, fluid can flow first past the seal contact surface and then past the resilient member.

In some embodiments, a first resilient member contact surface between the resilient member and the base is downstream of the seal contact surface along the second direction plug boss when the base and the cover are connected and the plug and the resilient member are positioned in the fluid chamber; the plug comprises a plug boss, the plug contacting the resilient member at a second resilient member contact surface with the plug boss positioning the resilient member along the central axis the base and the cover connected and the plug and the resilient member positioned in the fluid chamber, wherein the plug boss does not extend along the central axis past the first resilient member contact surface when the base and the cover are connected and the plug and the resilient member are positioned in the fluid chamber; the base comprises a base boss centered on the central axis, the resilient member configured to be positioned about the base boss plug boss when the base and the cover are connected and the plug and the resilient member are positioned in the fluid chamber, wherein the plug boss does not extend past the base boss plug boss when the base and the cover are connected and the plug and the resilient member are positioned in the fluid chamber; the cover comprises a first gasket groove, and the plug comprises a second gasket groove, and wherein the seal contact surface comprises a first gasket positioned in the second gasket groove, the first gasket positioned in the first and second gasket grooves when the plug is biased against the cover to form the first seal with the base and the cover connected and the plug and the resilient member positioned in the fluid chamber; the base further comprises a projection connected to a periphery of the base and extending radially outward from the central axis, wherein the cover comprises a conduit with a cutout configured to receive the projection therethrough, wherein when the projection is received through the cutout, the base is rotated about the central axis to move the projection into the conduit to connect the base and the cover to each other in fixed positions relative to each other along the central axis; the valve assembly further comprises a nut comprising a nut flange circumscribing the nut about the central axis, wherein the nut and the cover are connected to each other in fixed positions relative to each other along the central axis to form a channel between the cover and the nut, the channel configured to clamp a material in the channel to position the valve assembly in a predetermined position relative to the material; the material which the channel is configured to clamp forms at least a part of an exterior of a casing configured to house an inflatable object configured to be connected to the valve assembly; a casing configured to house an inflatable object is configured to enclose the valve assembly and the material which the channel is configured to clamp; and/or the seal contact surface circumscribes the resilient member about the central axis.

In accordance with embodiments disclosed herein, a low profile valve is provided. The low profile valve can comprise an internal chamber comprising an upper surface and a lower surface, wherein a central axis of the low profile valve passes through the upper surface and the lower surface. The low profile valve can further comprise an actuator mounted movably along the central axis. The low profile valve can further comprise a spring positioned along the central axis in the internal chamber between the upper surface and the lower surface. The low profile valve can further comprise a peripheral seal connected to the actuator, the peripheral seal circumscribing the spring about the central axis, wherein the peripheral seal moves with the actuator along the central axis. The spring can bias the actuator for the peripheral seal to inhibit fluid flow through the internal chamber. The peripheral seal is moved along the central axis for fluid to flow through the internal chamber.

In some embodiments, the low profile valve comprises a conduit configured to convey fluid therein, the conduit in fluid communication with the internal chamber, wherein the peripheral seal is moved along the central axis to create fluid communication between the conduit and ambient air through the internal chamber; the low profile valve comprises a nozzle having the conduit extending therethrough, the nozzle configured to connect to an inflatable object; the lower surface comprises a lower surface boss, the spring at least partially circumscribing the lower surface boss to position the spring along the central axis; the lower surface boss extends a first predetermined distance along the central axis from the lower surface to limit movement of the actuator when the lower surface boss contacts the upper surface of the internal chamber; the upper surface comprises an upper surface boss, the spring at least partially circumscribing the upper surface boss to position the spring along the central axis, wherein the upper surface boss extends a second predetermined distance along the central axis from the upper surface to limit movement of the actuator when the upper surface boss contacts the lower surface boss; the upper surface comprises an upper surface boss, the spring at least partially circumscribing the upper surface boss to position the spring along the central axis; the upper surface boss extends a second predetermined distance along the central axis from the upper surface to limit movement of the actuator when the upper surface boss contacts the lower surface of the internal chamber; the actuator and the peripheral seal are connected by an actuator wall extending along the central axis, the actuator wall circumscribing the spring about the central axis; the peripheral seal radially extends from the actuator wall; the low profile valve comprises a valve wall extending to the internal chamber along the central axis, the valve wall at least partially enclosing the actuator wall about the central axis, wherein the actuator wall is configured to slidingly move along the valve wall when the actuator is moved along the central axis; the low profile valve comprises an internal chamber wall of the internal chamber, the internal chamber wall at least partially enclosing the peripheral seal about the central axis, wherein the peripheral seal is configured to slidingly move along the internal chamber wall when the actuator is moved along the central axis; the peripheral seal comprises a first gasket configured to contact a seal surface of the internal chamber to inhibit fluid flow through the internal chamber; the peripheral seal comprises a first gasket groove configured to engage the first gasket to inhibit fluid flow through the internal chamber; the seal surface comprises a second gasket groove configured to engage the first gasket to inhibit fluid flow through the internal chamber; the low profile valve comprises a top and a bottom, the top and the bottom in contact along an internal chamber periphery to form the internal chamber, the internal chamber periphery circumscribing the spring about the central axis; the low profile valve comprises a second gasket between the top and the bottom, the second gasket positioned along the internal chamber periphery; at least one of the top or the bottom comprises a third gasket groove positioned along the internal chamber periphery, the third gasket groove engaging the second gasket; the bottom further comprises a projection extending radially outward from the central axis, wherein the top comprises a conduit with a cutout configured to receive the projection therethrough, wherein when the projection is received through the cutout, the bottom is rotated about the central axis to move the projection into the conduit to connect the bottom and the top to each other in fixed positions relative to each other along the central axis; the low profile valve further comprising a peripheral channel extending radially outward from the central axis, the peripheral channel configured to engage a material in the peripheral channel to position the low profile valve in a predetermined position relative to the material; the material which the peripheral channel is configured to engage forms at least a part of an exterior of a casing housing an inflatable object configured to be connected to the low profile valve; a casing housing an inflatable object is configured to enclose the low profile valve and the material in engagement with the peripheral channel; the low profile valve comprise sa first peripheral flange about the central axis and a second peripheral flange about the central axis, the first and second peripheral flanges forming the peripheral channel; and/or the low profile valve comprises a cap having the first peripheral flange, the cap configured to rotate about the central axis to adjust a dimension of the channel along the central axis for clamping the material.

The foregoing is a summary and contains simplifications, generalization, and omissions of detail. Those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1:
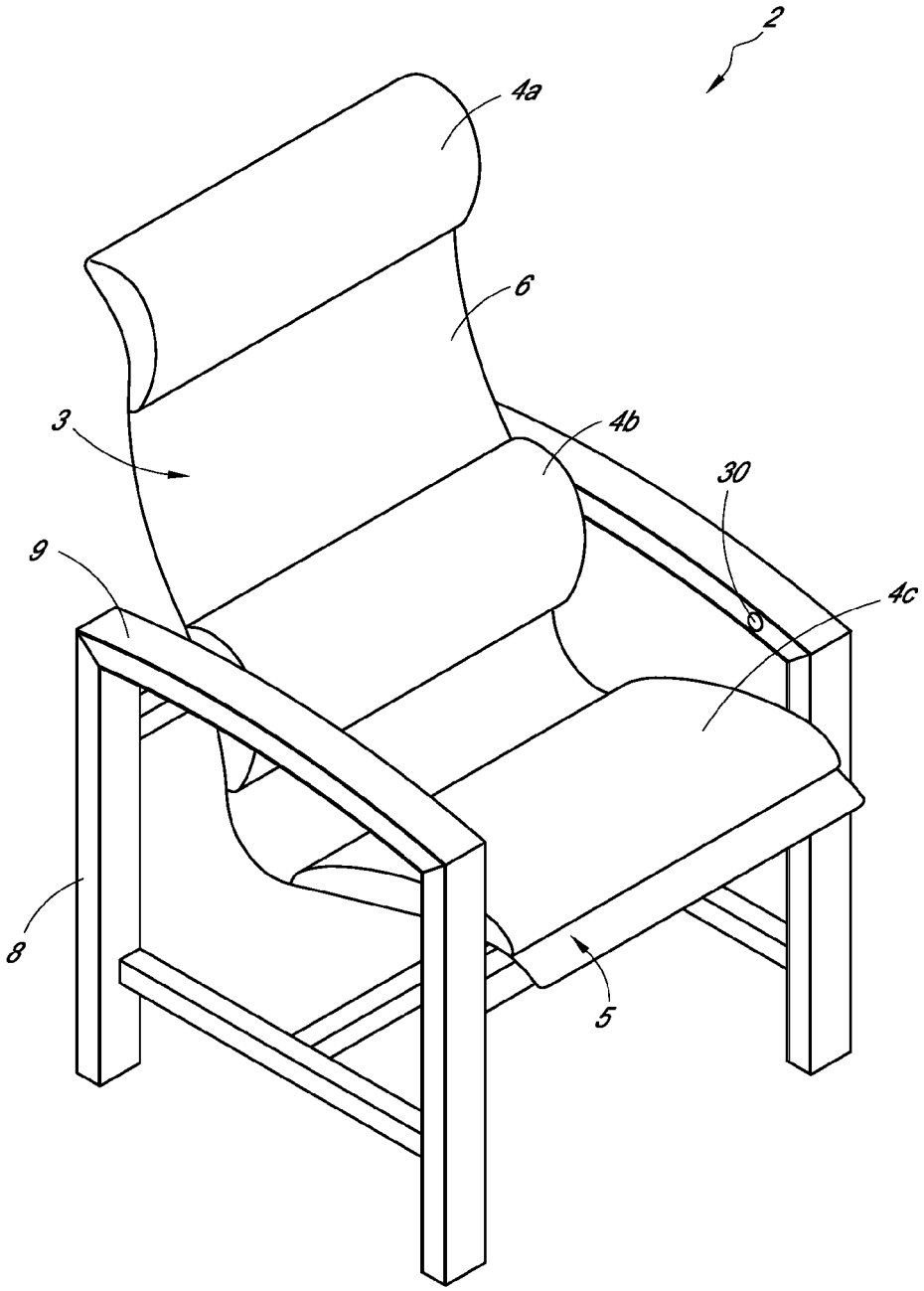
FIG. 1 illustrates a front perspective view of an embodiment of a seating with adjustable cushions.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

In particular, disclosed herein are seatings, including chairs, chaises, sofas, etc., which utilize an adjustable cushion to improve seating comfort and a valve for adjusting the adjustable cushion.

Adjustable Seating

FIG. 1 illustrates a front perspective view of an embodiment of a seating 2 with adjustable cushions. The seating 2, as illustrated in FIG. 1, can be a chair that an occupant sits in. The seating 2 can have a frame 8 that rests on a surface, such as, for example, a floor, deck, or ground. The frame 8 can have an armrest 9 for resting an arm of the occupant. The seating 2 can have a backrest 3 and a seat 5 that defines a general seating area for the occupant. The backrest 3 can define a back area of the seating 2. The seat 5 can define a seat area of the seating 2. Together, the back area and the seat area can be the general seating area for the occupant. The backrest 3 can transition directly into the seat 5 to form a connection between the backrest 3 and the seat 5 as illustrated in FIG. 1. The backrest 3 and seat 5 can be a sling 6 that is supported by the frame 8. In some embodiments, the sling 6 can be a fabric that is suspended between a frame of the seating 2 as discussed herein, and in particular, in reference to FIG. 3. The backrest 3 and the seat 5 (e.g., of the sling 6) can be padded with cushions. The cushions can be adjustable. The adjustable cushions can be operated by a seating occupant to change shape and/or support (e.g., firmness) of the adjustable cushions to achieve a desired level of comfort. The backrest 3 can have an adjustable cushion 4*a* generally at a head region of the seating 2. The backrest 3 can have another adjustable cushion 4*b* at the lumbar region of the seating 2, thereby using two adjustable cushions. The seat 5 can have yet another adjustable cushion 4*c*. The backrest 3 can have adjustable cushions spaced apart as shown in the drawing, or they can be close to one another to cover substantially all of the backrest 3, using, for example, 3, 4 or 5 cushions. In some embodiments, an air control valve 30 to operate the adjustable cushions as discussed herein can be positioned in the armrest 9.

As illustrated in FIG. 1, the seat adjustable cushion 4*c* can be sized to cover all or substantially all of the seating area provided by the seat 5. In some embodiments, the adjustable cushion 4*c* can cover any fraction of the seat 5, including about ¼, about ⅓, about ½, about ⅔, and about ¾, to provide the desired adjustability for support and comfort. The area of the seat 5 not covered by the adjustable cushion 4*c* can have sling fabric 6 without other cushioning and/or can include non-adjustable cushions as discussed herein. In some embodiments, the adjustable cushions 4*a*, 4*b*, 4*c* can be directly adjacent to each other to cover entirely or nearly entirely the seating area defined by the backrest 3 and the seat 5.

As illustrated in FIG. 1, the head and lumbar adjustable cushions 4*a* and 4*b* can each be about ¼ of the backrest 3. In some embodiments, the head adjustable cushion 4*a* can cover any fraction of the backrest 3, including about ⅓ and about ½. The lumbar adjustable cushion 4*b* can have cover any fraction of the back rest 3, including about ⅓ and about ½. The regions of the backrest 3 not covered by the adjustable cushions 4*a*, 4*b* can have sling fabric 6 without other cushioning and/or can include non-adjustable cushions as discussed herein. In some embodiments, the head adjustable cushion 4*a* and the lumbar adjustable cushion 4*b* can be a single unitary cushion on an entire or substantially entire region of the backrest 3, similar to the seat adjustable cushion 4*c* illustrated in FIG. 1 to be entire or substantially entire region of the seat 5. The single unitary cushion of the backrest 3 can cover any fraction of the backrest 3, including about ¼, about ⅓, about ½, about ⅔, and about ¾, to provide the desired adjustability for support and comfort.

Figure 2B:
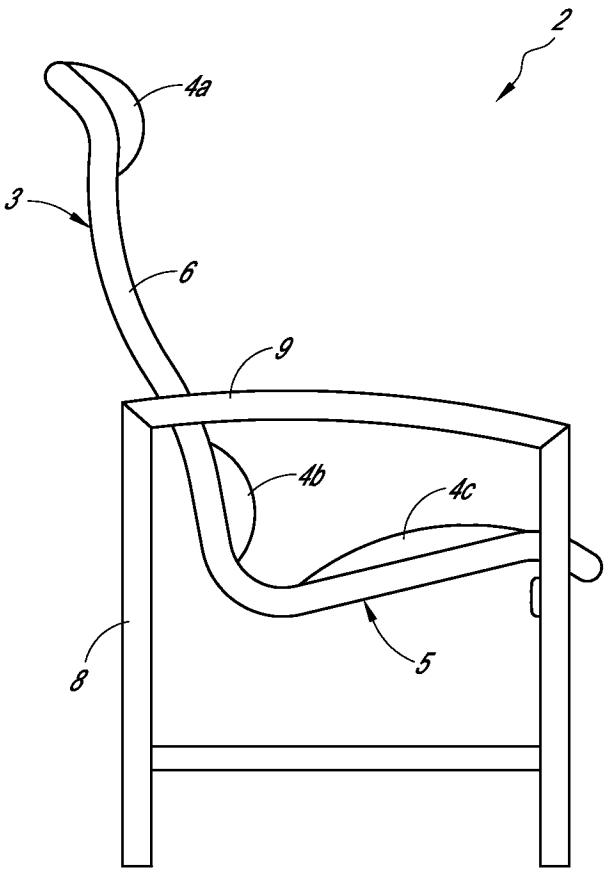
FIG. 2B illustrates a side view of an embodiment showing a compressed state of adjustable cushions of a seating.
Figure 2A:
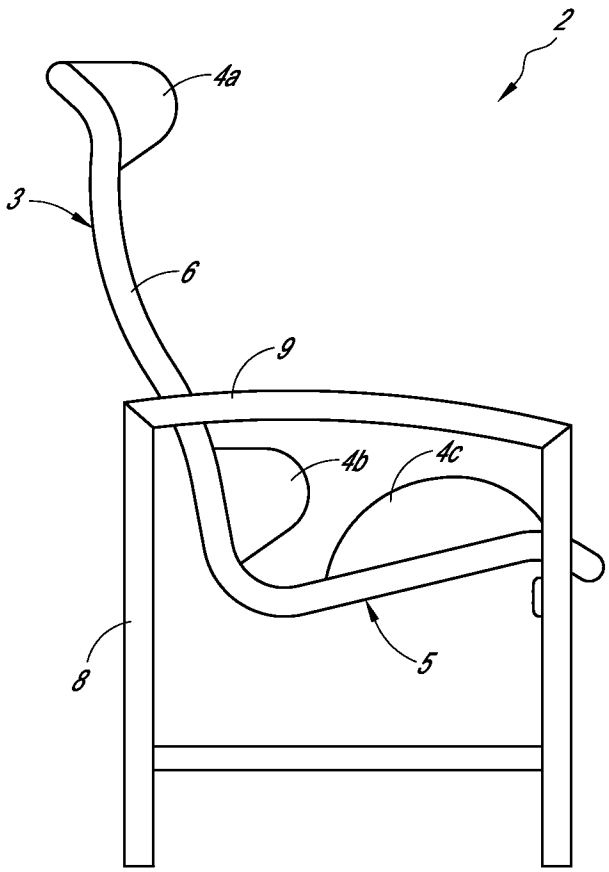
FIG. 2A illustrates a side view of an embodiment showing an uncompressed state of adjustable cushions of a seating.

FIG. 2A illustrates a side view of an embodiment showing an uncompressed and/or at least partially expanded state of the adjustable cushions 4*a*, 4*b*, 4*c* of a seating 2. When at least partially expanded, the adjustable cushions 4*a*, 4*b*, 4*c* can have a convex shape that projects away from the surface of the sling 6. The convex shape of the adjustable cushions 4*a*, 4*b*, 4*c* in a fully expanded or full thickness state can be adjusted based on cushion type, density, and/or size of foam used in the cushions as discussed herein to achieve desired support and comfort.

FIG. 2B illustrates a side view of an embodiment showing a compressed and/or at least partially deflated state of the adjustable cushions 4*a*, 4*b*, 4*c* of a seating 2. When at least partially compressed, the adjustable cushions 4*a*, 4*b*, 4*c* can have also a convex shape that projects away from the surface of the sling 6. The radius of the convex shape in a compressed state (FIG. 2B) can be larger than the radius of the convex shape in an expanded state (FIG. 2A). The adjustable cushions 4*a*, 4*b*, 4*c* in the compressed state (FIG. 2B) can project from the surface of the sling 6 less than in the expanded state (FIG. 2A). In some embodiments, the adjustable cushions 4*a*, 4*b*, 4*c* can be flush or substantially flush with the surface of the sling 6 when in the compressed state.

Adjusting the adjustable cushions 4*a*, 4*b*, 4*c* between the compressed and expanded states as discussed herein can include the following. Where a seat occupant desires the head cushion 4*a* to have less thickness, the occupant can press against the head cushion 4*a* while simultaneously opening a valve so that air can be expelled from within an open cell foam, as discussed herein, to obtain a desired thickness and/or firmness for the occupant's head, neck, shoulder, and/or upper back region as illustrated in FIG. 2B by the compressed state. Conversely, where the occupant desires the head cushion 4*a* to be thicker or to have a fully expanded size, the occupant can momentarily raise the occupant's head, neck, shoulder and/or upper back region from the surface of the head cushion 4*a* while operating the valve to permit the vacuum condition in the open cell foam material, as discussed herein, to take in ambient air through the valve into the open cell foam as illustrated in FIG. 2A by the expanded state.

Where the seat occupant desires the lumbar cushion 4*b* to have less thickness, the occupant can press against the lumbar cushion 4*a* while simultaneously opening a valve so that air can be expelled from within an open cell foam, as discussed herein, to obtain a desired thickness and/or firmness for the occupant's lumbar and/or lower back region as illustrated in FIG. 2B by the compressed state. Conversely, where the occupant desires the lumbar cushion 4*b* to be thicker or to have a fully expanded size, the occupant can momentarily raise the occupant's lumbar and/or lower back region from the surface of the lumbar cushion 4*a* while operating the valve to permit the vacuum condition in the open cell foam material, as discussed herein, to take in ambient air through the valve into the open cell foam as illustrated in FIG. 2A by the expanded state.

Where the seat occupant desires the seat cushion 4*c* to have less thickness, the occupant can press against the seat cushion 4*a* while simultaneously opening a valve so that air can be expelled from within an open cell foam, as discussed herein, to obtain a desired thickness and/or firmness for the occupant's buttocks and/or leg region as illustrated in FIG. 2B by the compressed state. Conversely, where the occupant desires the seat cushion 4*b* to be thicker or to have a fully expanded size, the occupant can momentarily raise the occupant's buttocks and/or leg region from the surface of the lumbar cushion 4*a* (i.e., standing up or at least partially supporting the occupant's weight against an armrest 9) while operating the valve to permit the vacuum condition in the open cell foam material, as discussed herein, to take in ambient air through the valve into the open cell foam as illustrated in FIG. 2A by the expanded state.

Figure 3:
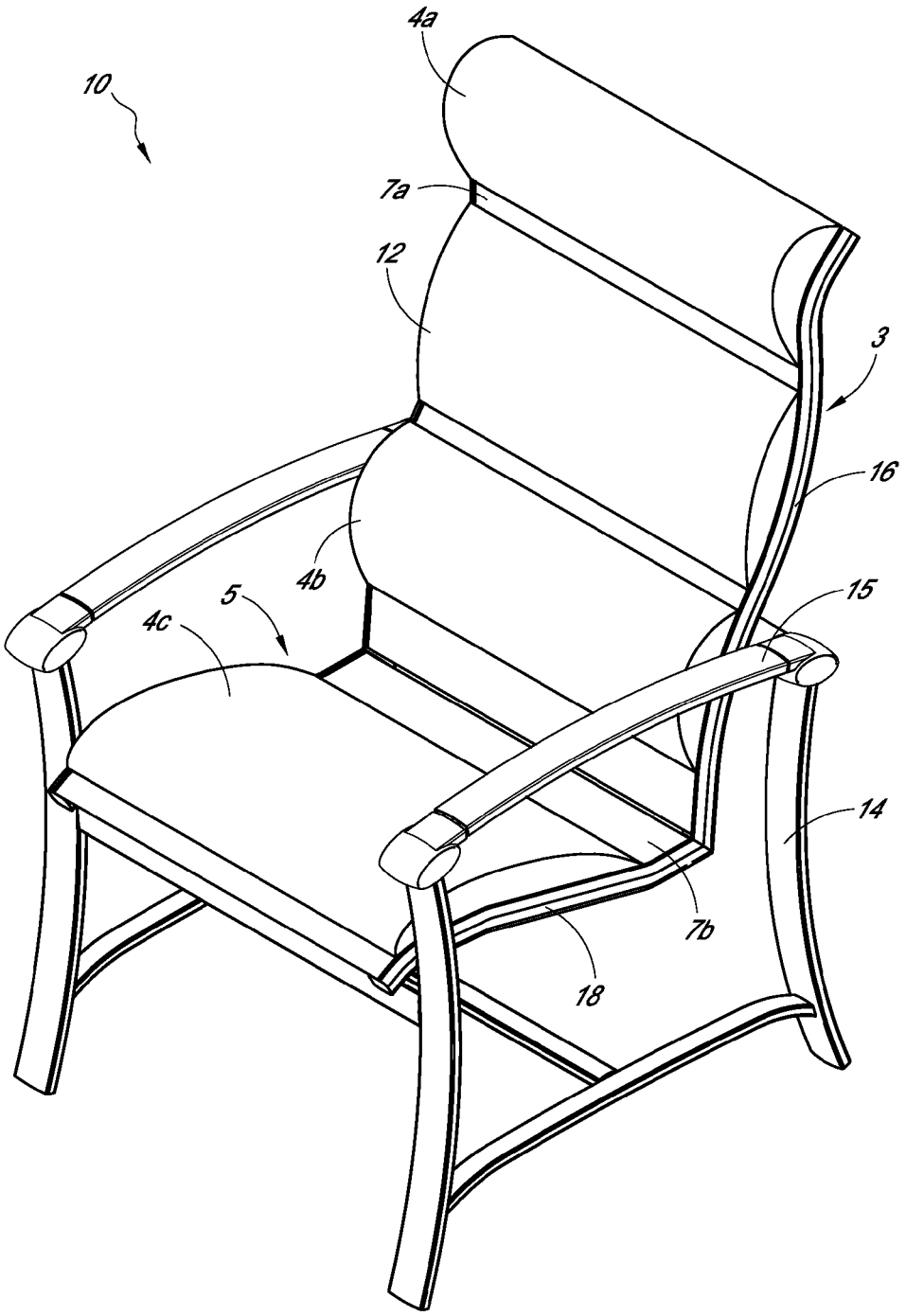
FIG. 3 illustrates a front perspective view of an embodiment of a seating with adjustable and non-adjustable cushions.

FIG. 3 illustrates a front perspective view of an embodiment of a seating 10 with adjustable and non-adjustable cushions. The seating 10 has a frame 14 that rests on a surface, such as, for example, a floor, deck, or ground. The frame 14 can have an armrest 15 for resting an arm of a seating occupant. The seating 10 can have a backrest 3 and a seat 5 that defines a general seating area for the occupant. The backrest 3 can be connected to the seat 5. The connection between the backrest 3 and the seat 5 can be a fixed connection at an angle or can be a hinged connection to allow the backrest 3 to pivot relative to the seat 5. The connection between backrest 3 and the seat 5 can be formed such that the angle between the backrest 3 and seat 5 increases when an occupant applies the occupant's weight to the backrest 3. The backrest 3 and seat 5 can return to an initial angle between the backrest 3 and the seat 5 when the occupant no longer applies the occupant's weight to the backrest 3. The backrest 3 can have sling channels 16 that are connected to the frame 14. The sling channels 16 can support a sling 7*a*. The sling channels 16 can have conduits or channels that accept corresponding rail loops or sling rails 32 (FIG. 11) in the sling 7*a* as discussed herein to suspend the sling 7*a* between the sling channels 16 of the backrest 3. The seat 5 can have a frame with sling channels 18. The sling channels 18 can support a sling 7*b*. The sling channels 18 can have conduits or channels that accept corresponding sling rails 32 (FIG. 11) in the sling 7*b* as discussed herein to suspend the sling 7*b* between the sling channels 18 of the seat 5. The frames and sling channels of the seatings discussed herein can be made with any suitable material, such as die cast, stamp-pressed, and/or extruded aluminum, including aluminum alloys. Other suitable materials can include any suitable form or alloy of cast or wrought iron or carbon steel, including stainless steel.

The backrest 3 and seat 5 of the seating 10 can be padded with cushions. The cushions can be adjustable. The adjustable cushions can be operated by a seating occupant to change shape and/or firmness of the adjustable cushions to achieve a desired level of support and comfort. The backrest 3 can have an adjustable cushion 4*a* generally at a head region of the seating 10. The backrest 3 can have another adjustable cushion 4*b* at the lumbar region of the seating 10. The seat 5 can have yet another adjustable cushion 4*c*. The adjustable cushions 4*a*, 4*b*, 4*c* can be positioned on the seating 10 and function as discussed herein and in particular, in reference to FIGS. 1, 2A, and 2B.

As illustrated in FIG. 3, the backrest 3 can have a non-adjustable cushion 12 in the general area of the back.

The non-adjustable cushion 12 can be a conventional cushion with padding/foam materials and arrangements normally used in the furniture industry. The non-adjustable cushion 12 can be positioned anywhere on the backrest 3 including between the adjustable cushions 4*a* and 4*b*. The area of the backrest 3 not covered by the cushions can be the sling fabric 7*a* providing seating support. In some embodiments, the non-adjustable cushion 12 can be positioned directly adjacent to the adjustable cushions 4*a* and 4*b* to define an entire or substantially an entire seating area of the backrest 3. In some embodiments, the cushions 4*a*, 12, 4*b* can be formed from a single sheet of material. For example, the cushions 4*a*, 12, 4*b* can be formed from a connection to the sling fabric 7*a*. In some embodiments, the cushions 4*a*, 12, 4*b*, 4*c* can be formed from a single sheet of material. For example, the cushions 4*a*, 12, 4*b*, 4*c* can be formed from a connection to the sling fabric 7*a*, 7*b*. In some embodiments, the seat 5 can have a non-adjustable cushion without or without adjustable cushions. For example, the cushion 4*c* may be a non-adjustable cushion.

Figure 4B:
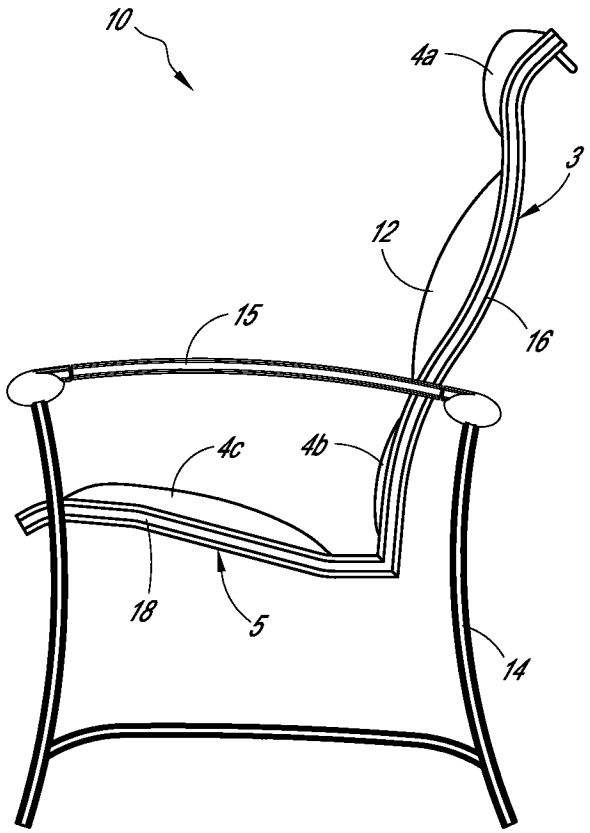
FIG. 4B illustrates a side view of an embodiment showing a compressed and/or at least partially deflated state of adjustable cushions of a seating.
Figure 4A:
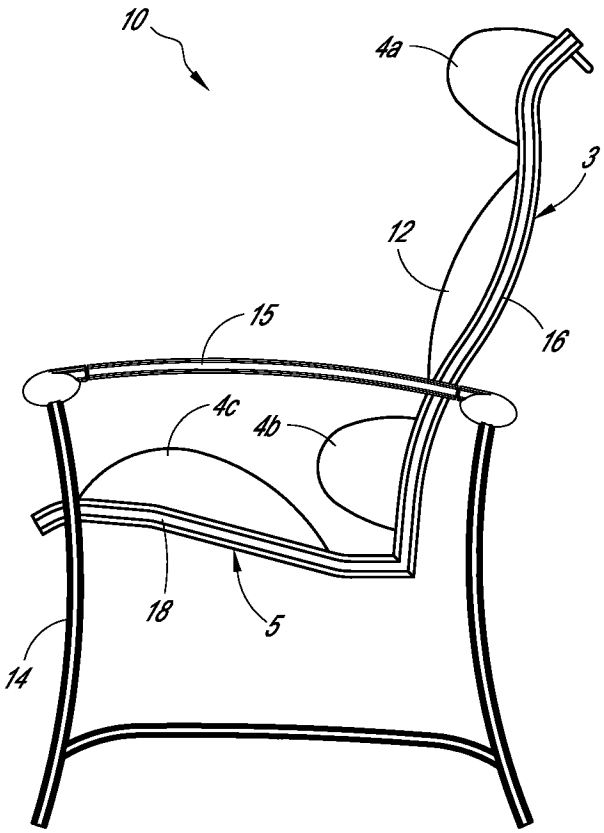
FIG. 4A illustrates a side view of an embodiment showing an uncompressed and/or at least partially expanded state of adjustable cushions of a seating.

FIG. 4A illustrates a side view of an embodiment showing an uncompressed and/or at least partially expanded state of the adjustable cushions 4*a*, 4*b*, 4*c* of a seating 10. FIG. 4B illustrates a side view of an embodiment showing a compressed and/or at least partially deflated state of the adjustable cushions 4*a*, 4*b*, 4*c* of a seating 10. FIGS. 4A and 4B illustrate similar functionality and arrangement of adjustable cushions 4*a*, 4*b*, 4*c* as discussed herein, and in particular, in reference to FIGS. 2A and 2B. FIGS. 4A and 4B further illustrate that between the expanded and compressed states of the adjustable cushions 4*a*, 4*b*, 4*c*, the shape, contour, and/or convexity (e.g., profile) of the non-adjustable cushion 12 can stay the same or nearly the same (i.e., without an occupant). As the adjustable cushions 4*a*, 4*b*, 4*c* are expanded as illustrated in FIG. 4A, the non-adjustable cushion 12 does not expand or change in profile. FIG. 4B illustrates that in a compressed state, the non-adjustable cushion 12 can have a similar or substantially similar profile as the adjustable cushions 4*a*, 4*b*, 4*c*. While FIG. 4A illustrate a relative difference in profile between the adjustable cushion 4*a*, 4*b*, 4*c* and the non-adjustable cushion 12 when the adjustable cushions 4*a*, 4*b*, 4*c* are in the expanded state, the adjustable cushions 4*a*, 4*b*, 4*c*, in some embodiments, may have a similar or substantially the same and/or smaller profile compared to the non-adjustable cushion 12 even when in the expanded state. While FIG. 4B illustrates a relatively same or substantially same profile between the adjustable cushion 4*a*, 4*b*, 4*c* and the non-adjustable cushion 12 when the adjustable cushions 4*a*, 4*b*, 4*c* are in the compressed state, the adjustable cushions 4*a*, 4*b*, 4*c*, in some embodiments, may have a relatively smaller and/or larger profile compared to the non-adjustable cushion 12. For example, FIG. 4B illustrates adjustable cushion 4*c* having a smaller profile than the non-adjustable cushion 12. The profiles of the adjustable cushions 4*a*, 4*b*, 4*c* can differ in relation to each other when the adjustable cushions 4*a*, 4*b*, 4*c* are in a similar state (e.g., fully expanded state). Thus, the adjustable cushion 4*a*, 4*b*, 4*c* can be arranged to have varying shapes, contours, and/or convexities.

Figure 5:
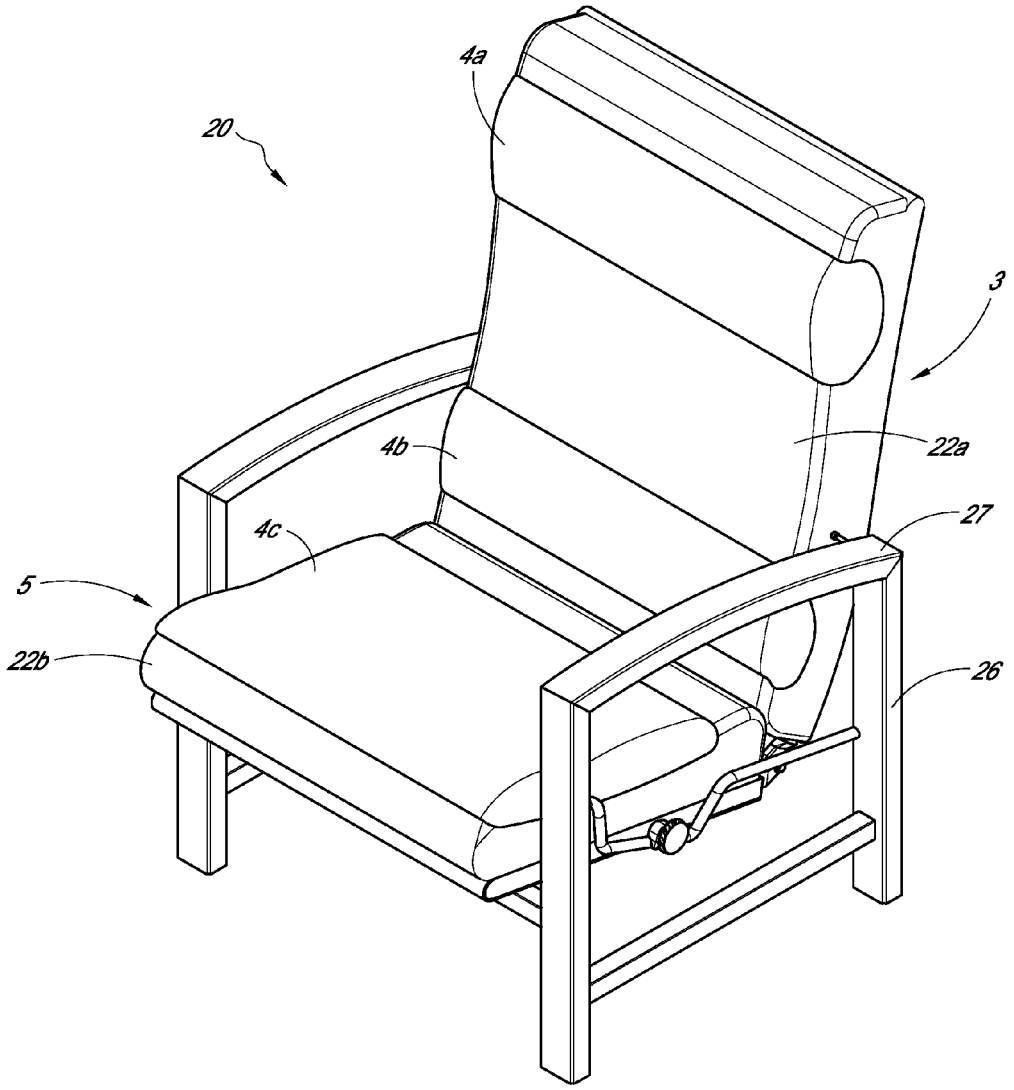
FIG. 5 illustrates a front perspective view of an embodiment of a seating with adjustable and non-adjustable cushions.

FIG. 5 illustrates a front perspective view of an embodiment of a seating 20 with adjustable and non-adjustable cushions. The seating 20 has a frame 26 that rests on a surface, such as, for example, a floor, deck, or ground. The frame 26 can have an armrest 27 for resting an arm of a seating occupant. The seating 20 can have a backrest 3 and a seat 5 that defines a general seating area for the occupant. The backrest 3 can be connected to the seat 5. The connection between the backrest 3 and the seat 5 can be a fixed connection at an angle or can be a hinged connection to allow the backrest 3 to pivot relative to the seat 5. The connection between backrest 3 and the seat 5 can be formed such that the angle between the backrest 3 and seat 5 increases when an occupant applies the occupant's weight to the backrest 3. The backrest 3 and seat 5 can return to an initial angle between the backrest 3 and the seat 5 when the occupant no longer applies the occupant's weight to the backrest 3. The backrest 3 can have a non-adjustable deep-seat cushion 22*a*. The seat 5 can have a non-adjustable deep-seat cushion 22*b*.

The backrest 3 and seat 5 can have adjustable cushions 4*a*, 4*b*, 4*c*. The adjustable cushions can be operated by a seating occupant to change shape and/or support (e.g., firmness) of the adjustable cushions to achieve a desired level of comfort. The backrest 3 can have an adjustable cushion 4*a* generally at a head region of the seating 20. The backrest 3 can have another adjustable cushion 4*b* at the lumbar region of the seating 20. The seat 5 can have yet another adjustable cushion 4*c*. The adjustable cushions 4*a*, 4*b*, 4*c* can be positioned on the seating 20 and function as discussed herein and in particular, in reference to FIGS. 1, 2A, 2B, 3, 3A, and 3B.

Figure 6B:
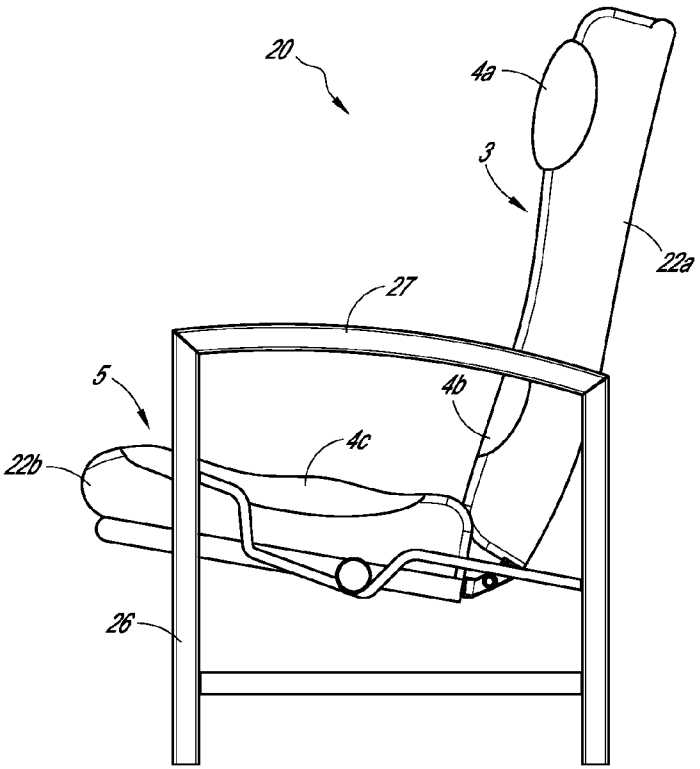
FIG. 6B illustrates a side view of an embodiment showing a compressed state of adjustable cushions of a seating.
Figure 6A:
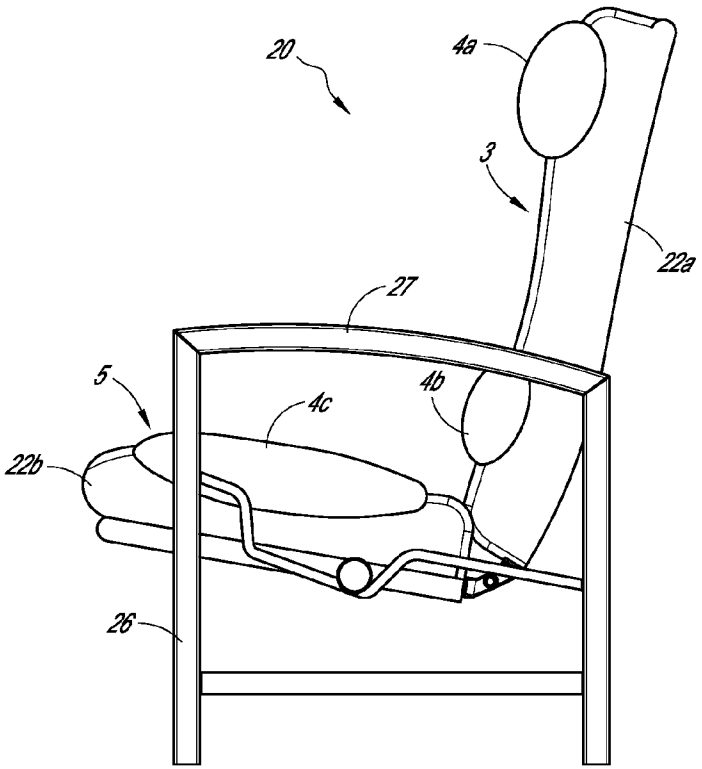
FIG. 6A illustrates a side view of an embodiment showing an uncompressed state of adjustable cushions of a seating.

The adjustable cushions 4*a*, 4*b*, 4*c* can have shapes, contours, and/or convexities (e.g., profiles) relative the non-adjustable cushions 22*a*, 22*b* as discussed herein, and in particular, in reference to FIGS. 3, 3A, and 3B. The adjustable cushions 4*a*, 4*b*, 4*c* can be embedded or be a part of the non-adjustable cushions 22*a*, 22*b*. For example, a padding device comprising the adjustable cushion 4 as a whole can be inserted as a separate unit into the non-adjustable cushions 22*a*, 22*b*. The non-adjustable cushions 22*a*, 22*b* can be formed with a pocket to accept the adjustable cushions 4*a*, 4*b*, 4*c*. The non-adjustable cushions 22*a*, 22*b* can built on an internal or integral frame with support straps. The support straps can be connected to the adjustable cushions 4*a*, 4*b*, 4*c* to help station the adjustable cushions 4*a*, 4*b*, 4*c* in place relative to the integral frame and/or the non-adjustable cushions 22*a*, 22*b*. In some embodiments, the adjustable cushion 4 can be embedded into the non-adjustable cushion 22*a*, 22*b* where, for example, the support foam 48 forms at least a portion of the padding or foam in the non-adjustable cushion 22*a*, 22*b*. FIG. 6A illustrates a side view of an embodiment showing an uncompressed and/or at least partially expanded state of the adjustable cushions 4*a*, 4*b*, 4*c* of a seating 20. FIG. 6B illustrates a side view of an embodiment showing a compressed and/or at least partially deflated state of the adjustable cushions 4*a*, 4*b*, 4*c* of a seating 20. FIGS. 6A and 6B illustrate similar functionality and arrangement of adjustable cushions 4*a*, 4*b*, 4*c* as discussed herein, and in particular, in reference to FIGS. 2A and 2B. FIGS. 6A and 6B further illustrate that the adjustable cushions 4*a*, 4*b*, 4*c* can project beyond the surface or plane of the non-adjustable cushions 22*a*, 22*b* in both the expanded and compressed states. In some embodiments, the adjustable cushions 4*a*, 4*b*, 4*c* may be flush or substantially flush with the surface or plane of the non-adjustable cushions 22*a*, 22*b* in the expanded states, compressed states, or both. For example, FIG. 6B illustrates the adjustable cushions 4*b* and 4*c* being flush with the non-adjustable cushion 22*a*, 22*b* in at least one of the compressed states.

Figure 7:
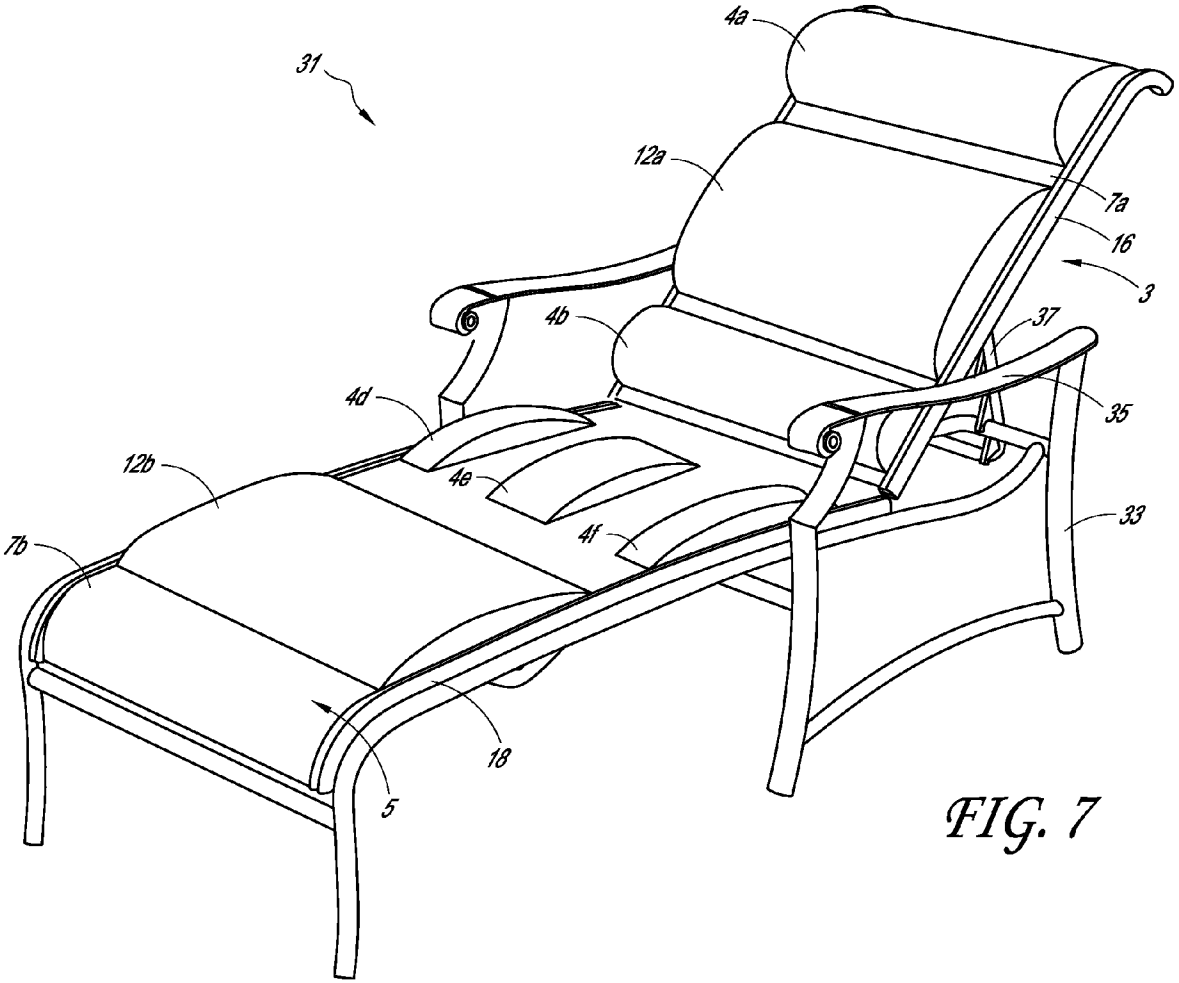
FIG. 7 illustrates a front perspective view of an embodiment of a seating with adjustable and non-adjustable cushions.

FIG. 7 illustrates a front perspective view of an embodiment of a seating 31 with adjustable and non-adjustable cushions. The seating 31 can be a chaise. The seating 31 has a frame 33 that rests on a surface, such as, for example, a floor, deck, or ground. The frame 31 can have an armrest 35 for resting an arm of a seating occupant. The seating 31 can have a backrest 3 and a seat 5 that defines a general seating area for the occupant. The backrest 3 can be connected to the seat 5. The connection between the backrest 3 and the seat 5 can be a fixed connection at an angle or can be a hinged connection to allow the backrest 3 to pivot relative to the seat 5. The seating 31 can have a support arm 37 connected to the backrest 3 and supported at a chosen point on the frame 33 to fix the backrest 3 at a desired angle relative to the seat 5. In some embodiments, the connection between backrest 3 and the seat 5 can be formed such that the angle between the backrest 3 and seat 5 increases when an occupant applies the occupant's weight to the backrest 3. The backrest 3 and seat 5 can return to an initial angle between the backrest 3 and the seat 5 when the occupant no longer applies the occupant's weight to the backrest 3. The backrest 3 can have sling channels 16 that are connected to the frame 14. The sling channels 16, 18 can support a sling 7*a*, 7*d* as discussed herein and in particular, in reference to FIGS. 3, 4A, and 4B.

The backrest 3 and seat 5 of the seating 31 can be padded with cushions. The cushions can be adjustable. The adjustable cushions can be operated by a seating occupant to change shape and/or firmness of the adjustable cushions to achieve a desired level of support and comfort. The backrest 3 can have an adjustable cushion 4*a* generally at a head region of the seating 31. The backrest 3 can have another adjustable cushion 4*b* at the lumbar region of the seating 31. The adjustable cushions 4*a*, 4*b* can be positioned on the seating 31 and function as discussed herein and in particular, in reference to FIGS. 1, 2A, and 2B. The backrest 3 can further have a non-adjustable cushion 12*a* in the general area of the back as discussed herein, and in particular, in reference to FIGS. 3, 4A, and 4B.

As illustrated in FIG. 7, the seating 31 can have adjustable cushions 4*d*, 4*e*, 4*f*. The adjustable cushions 4*d*, 4*e*, 4*f* can function and have features as discussed herein for adjustable cushions. The adjustable cushions 4*d*, 4*e*, 4*f* can be positioned in a region corresponding to the upper legs of an occupant. The adjustable cushions 4*d*, 4*e*, 4*f* of the seating 31 can be arranged to parallel the legs of the seating occupant to provide desired support to, for example, the upper legs of an occupant. The adjustable cushions 4*d*, 4*e*, 4*f* can at least partially encase the legs to provide cushioning and/or direct the legs along the length of the seat 5. The directional firmness and/or support of the adjustable cushions 4*d*, 4*e*, 4*f* can be changed (e.g., increased) from encasing at least half the circumference of the legs of the occupant such that the legs are strongly biased along the length of the seat 5. The firmness and/or support of the adjustable cushions 4*d*, 4*e*, 4*f* can be changed (e.g., decreased) to provide no or minimal directional support. In some embodiments, any combination the adjustable cushions 4*d*, 4*e*, 4*f* can be positioned in the seat 5 to parallel the legs of the occupant. For example, just two adjustable cushions 4*d*, 4*f* may be positioned as illustrated in FIG. 7 to parallel the outside of the occupant's legs. As another example, just one adjustable cushion 4*e* can be positioned as illustrated in FIG. 7 to parallel the inside of the occupant's legs. In some embodiments, any number or combination of paralleling adjustable cushions may be used to directionally support the legs of the occupant.

The seat 5 of the seating 31 can also have a non-adjustable cushion 12*b* at or near a region corresponding to the lower legs of the occupant. The non-adjustable cushion 12*b* can provide general cushioning support as discussed herein. In some embodiments, the position of the adjustable cushions 4*d*, 4*e*, 4*f* can be switched with the position of the non-adjustable cushion 12*b* such that the lower legs of the occupant are supported and directed along the length of the seat 5 as discussed herein for the upper legs. In some embodiments, the adjustable cushions 4*d*, 4*e*, 4*f* can extend an entire or substantially entire length of the seat 5 of the seating 31. In some embodiments, the adjustable cushions 4*d*, 4*e*, 4*f* can be about 1/6, 1/5, 1/4, 1/3, 1/2, 2/3, 3/4, 4/5, or 5/6 of the length of the seat 5. In some embodiments, the lengths of the adjustable cushion 4*d*, the adjustable cushion 4*e*, and the adjustable cushion 4*f* can vary independently of each other to any length of the seat 5 as discussed herein. In some embodiments, the non-adjustable cushions 12*b* can be about 1/6, 1/5, 1/4, 1/3, 1/2, 2/3, 3/4, 4/5, or 5/6 of the length of the seat 5.

Figure 8:
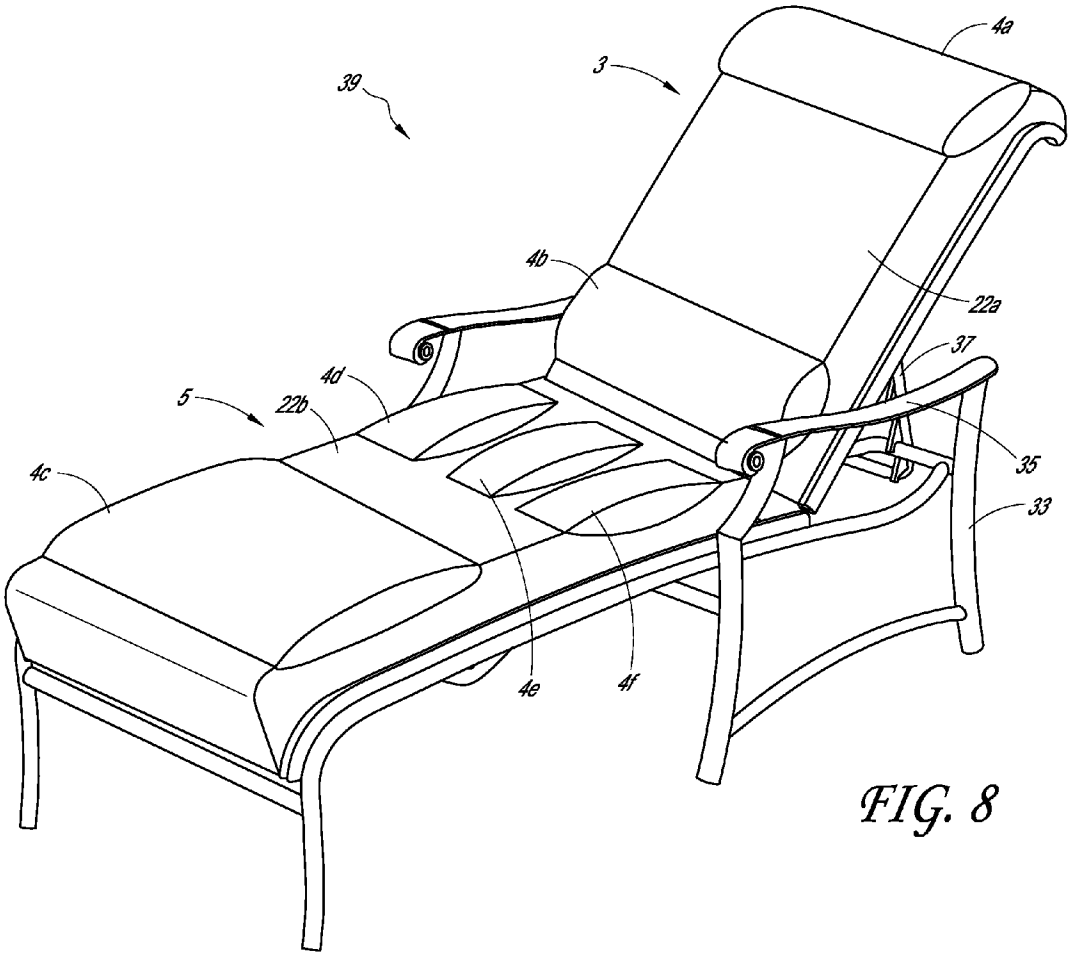
FIG. 8 illustrates a front perspective view of an embodiment of a seating with adjustable and non-adjustable cushions.

FIG. 8 illustrates a front perspective view of an embodiment of a seating 39 with adjustable and non-adjustable cushions. The seating 39 can be a chaise. The seating can have a frame 33, an armrest 35, a backrest 3, a support arm 37, and a seat 5 as discussed herein and in particular, in reference to FIG. 7. The backrest 3 can have a non-adjustable deep-seat cushion 22*a*. The seat 5 can have a non-adjustable deep-seat cushion 22*b*.

The backrest 3 and seat 5 can have adjustable cushions 4*a*, 4*b*, 4*c*. The adjustable cushions can be operated by a seating occupant to change shape and/or support (e.g., firmness) of the adjustable cushions to achieve a desired level of comfort. The backrest 3 can have an adjustable cushion 4*a* generally at a head region of the seating 39. The backrest 3 can have another adjustable cushion 4*b* at the lumbar region of the seating 39. The seat 5 can have yet another adjustable cushion 4*c*. The adjustable cushion 4*c* can be located in a region corresponding to the lower legs of the occupant. The seat 5 can have additional adjustable cushions 4*d*, 4*e*, 4*f* as discussed herein and in particular, in reference to FIG. 7. The adjustable cushions 4*a*, 4*b*, 4*c*, 4*d*, 4*e*, 4*f* can be positioned on the seating 39 and function as discussed herein and in particular, in reference to FIGS. 1, 2A, 2B, 3, 3A, and 3B, as well as FIG. 7.

The adjustable cushions 4*a*, 4*b*, 4*c*, 4*d*, 4*e*, 4*f* can have shapes, contours, and/or convexities (e.g., profiles) relative the non-adjustable cushions 22*a*, 22*b* as discussed herein, and in particular, in reference to FIGS. 3, 3A, and 3B as well as FIGS. 6, 6A, and 6B. The adjustable cushions 4*a*, 4*b*, 4*c* 4*d*, 4*e*, 4*f* can be embedded or be a part of the non-adjustable cushions 22*a*, 22*b* as discussed herein. In some embodiments, the adjustable cushions 4*c*, 4*d*, 4*e*, 4*f* can be connected or joined together to form a single adjustable cushion along substantially an entire length of the seat 5 or any other fractional portion of the seat 5 as discussed herein. The single adjustable cushion can maintain the features and functionality of the parallel adjustable cushions 4*d*, 4*e*, 4*f* as discussed herein even when connected together (e.g., envelopes 44 of the adjustable cushions 4*c*, 4*d*, 4*e*, 4*f* in fluid communication).

Figure 9:
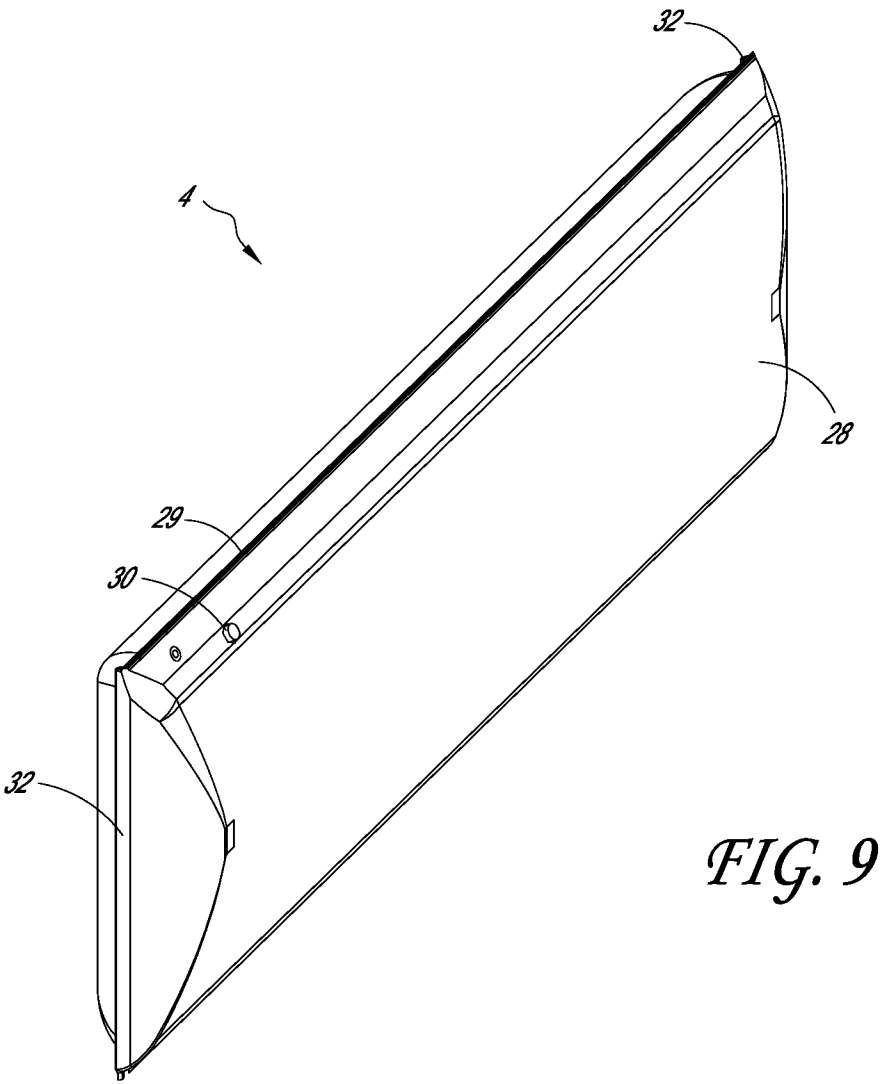
FIG. 9 illustrates a front perspective view of an embodiment of an adjustable cushion.

FIG. 9 illustrates a front perspective view of an embodiment of an adjustable cushion 4. The adjustable cushion 4 can have a face 28 that forms a front portion of the adjustable cushion 4 and faces the seating occupant. The face 28 can have a convex shape as discussed herein, and in particular, in reference to FIGS. 2A, 2B, 3A, 3B, 4A, and 4B. The adjustable cushion 4 can have an opening 42 (FIG. 12) in the face 28 for an air control valve 30 as discussed herein. The valve 30 can be a push button valve as discussed herein. The push button of the valve 30 can be flush or substantially flush with the surface of the face 28. The push button of the valve 30 being flush with face 28 can help prevent the push button from being a prominent feature to avoid accidental depression of the push button as well as help visually conceal the push button. Simultaneously, the push button can provide easy access (i.e., easily reachable by the occupant) and operation of the air control valve 30. The adjustable cushion 4 can have sling rails 32 to from a part of the sling 7*a*, 7*b* that slide into the conduits or channels of the sling channels 16, 18 as discussed herein and in particular, in reference to FIG. 3.

As illustrated in FIG. 9, the adjustable cushion 4 can be a modular unit separate from other adjustable and non-adjustable cushions. Any suitable combination of adjustable and non-adjustable cushions as discussed herein could be suspended on the sling channels 16, 18 to form the sling 7*a*, 7*b*. For example, referring to, for example, FIG. 3, adjustable cushion 4*b* can be separately suspended on the sling channels 16 near a bottom of the sling channels 16. The non-adjustable cushion 12 can then be separately suspended on the sling channels 16 above the adjustable cushion 4*b* near the middle of the sling channels 16. The adjustable cushion 4*a* can then be separately suspended on the sling channels 16 above the non-adjustable cushion 12 near the top of the sling channels 16. A suitable material can be suspended on the seating as discussed herein to provide flexible support that can desirably and/or for a predetermined range flex (e.g., stretch, yield, give) under a weight of a user in the seating while providing desirable rigidity to properly and/or desirably support the weight of the user.

In some embodiments, the sling 7*a*, 7*b* can be a single unit forming, for example, backs 34 (FIG. 10) of the adjustable cushions 4 as discussed herein. Thus, any suitable combinations of adjustable and non-adjustable cushions can share backs 34; the backs 34 can form the sling 7*a*, 7*b*. The internal components 51 (FIG. 12) can then be positioned on the sling 7*a*, 7*b* to form the adjustable cushions 4*a*, 4*b*, 4*c* as discussed herein, as well as any desirable combination with non-adjustable cushions 12.

Figure 10:
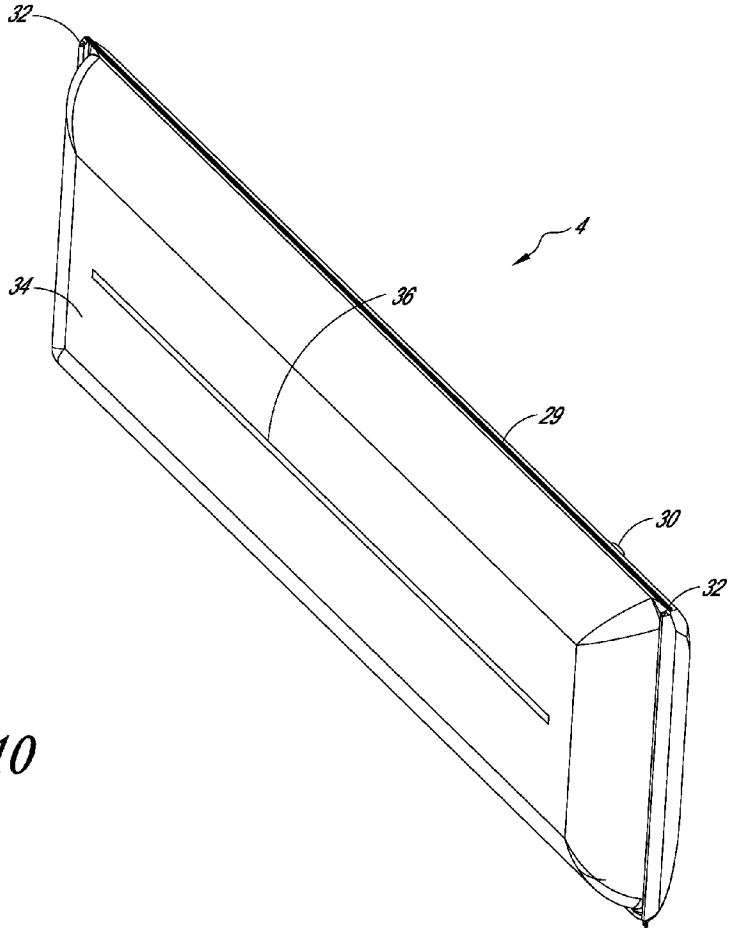
FIG. 10 illustrates a back perspective view of an embodiment of an adjustable cushion.

FIG. 10 illustrates a back perspective view of an embodiment of an adjustable cushion 4. The adjustable cushion 4 can have a back 34 that forms the back portion of the adjustable cushion 4 and faces away from the occupant. The back 34 can have a profile that is similar to the face 28.

Alternatively, in some embodiments, the back 34 can be substantially flat or level along seam 29. The back 34 can form a generally flat plane along the seam 29 with the profile of the back 34 not having or having minimal convexity. In some embodiments, the flat back 34 can form the cushionless portions of the sling 6, 7*a*, 7*b* as discussed herein, and in particular, in reference to FIGS. 1 and 3. In other words, the sling 6, 7*a*, 7*b* can be the fabric forming the back 34 without the cushion or padding components discussed herein. Thus, the back 34 can be flat along the seam 29 to form the sling 6, 7*a*, 7*b*.

The back 34 can have an access opening 36 along a length of the back 34 or along the seam 29. The access opening 36 can provide access to internal components 51 of the adjustable cushion 4. The internal components 51 of the adjustable 4 as discussed herein can include envelope (e.g. pouch, chamber, enclosure, shell) 44, adjustable foam 52, support foam 48, rigid backing (e.g., support member) 50, a valve 30, a tube 46 and/or like. The access opening 36 can be lined with, for example, a zipper or Velcro. The access opening 36 can be opened to install, adjust, replace, and/or remove the internal components 51 of the adjustable cushion 4. The access opening 36 can be large enough to provide access to the internal components 51 of the adjustable cushion 4 even when the adjustable cushion 4 is suspended between the sling channels 16, 18. The access opening 36 can be sized such that when the backing 34 is taut due to being suspended between the sling channels 16, 18, the access opening 36 substantially restricts the ability to install, adjust, replace, and/or remove the internal components 51 of the adjustable cushion 4 even when the access opening 36 may be fully opened (i.e., fully unzipping the zipper and/or separating the Velcro). Thus, even when opened, the access opening 36 may not provide enough maneuvering room to move the internal components 51 of the adjustable cushion 4. The restriction of the internal components 51 within the adjustable cushion 4 in its assembled and suspended state can help prevent shifting of the internal components 51 of the adjustable cushion 4 during use. In some embodiments, to install, adjust, replace, and/or remove the internal components 51 of the adjustable cushion 4, the frame 14 and/or sling channels 16, 18 of the seating 10 may have to disassembled or the sling 7*a*, 7*b* removed from the sling channels 16, 18 to provide sufficient slack in the sling 7*a*, 7*b* for access to the internal components 51 of the adjustable cushion 4.

Figure 11:
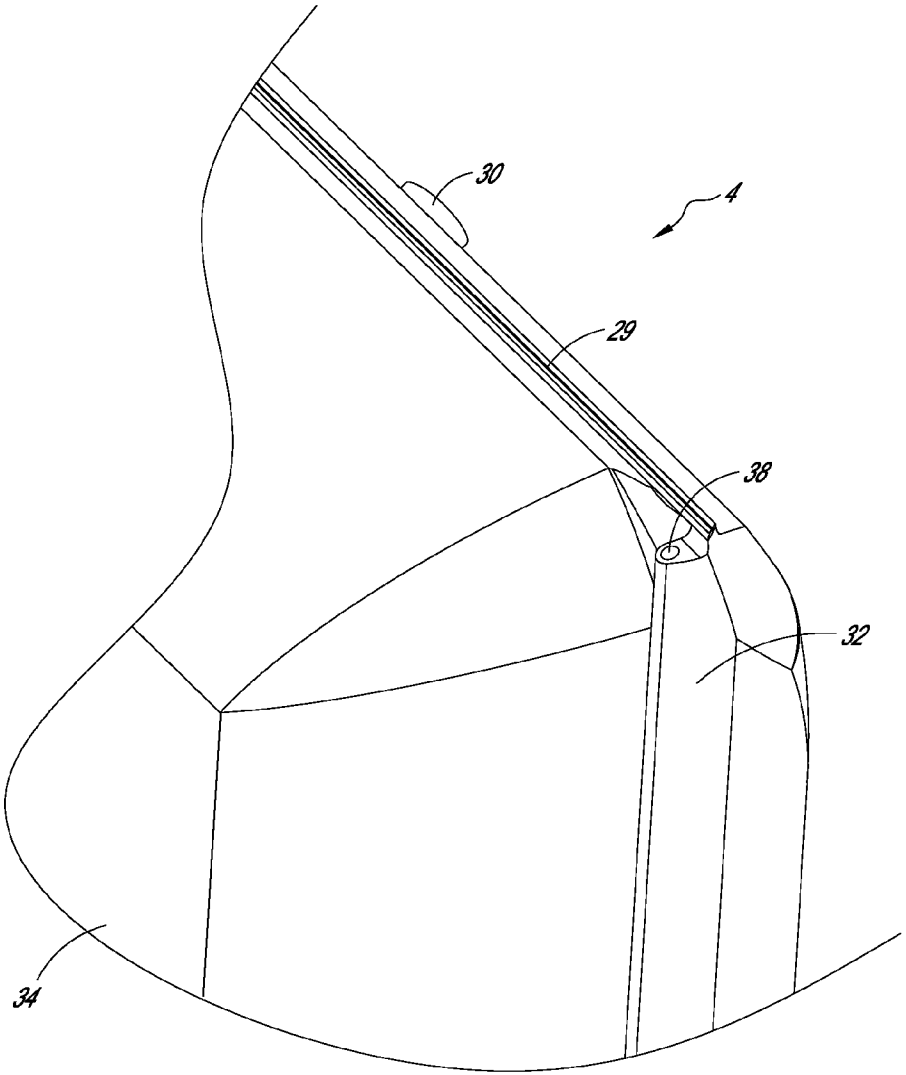
FIG. 11 illustrates a close-up back perspective view of an embodiment of an adjustable cushion.

FIG. 11 illustrates a close-up back perspective view of an embodiment of an adjustable cushion 4. The adjustable cushion can have sling rails 32 to engage the sling channels 16, 18 as discussed herein. The sling rails 32 can be formed by folding ends of the fabric material of the sling 7*a*, 7*b* over a rod 38 and securing the sling fabric using any suitable technique as discussed herein to form the rail channel 32 along a length (height) of the sling 7*a*, 7*b*. The sling rails 32 slide into the conduits or channels of the sling channels 16, 18 to inhibit lateral movement of the sling 7*a*, 7*b* by suspending the sling 7*a*, 7*b* between the sling channels 16, 18 when the frame 14 is assembled to make the sling 7*a*, 7*b* taut. The conduits of the sling channels 16, 18 can be sized such that the rod 38 cannot pass through a longitudinal opening in the conduits along the lengths of the sling rails 16, 18 while the longitudinal opening allows the sling fabric to pass through to form the back 34 of the adjustable cushion 4 and/or suspend the sling 7*a*, 7*b*. In some embodiments, the sling 7*a*, 7*b* (e.g., the back 34 of the casing 40) can be suspended and drawn taut primarily (or substantially) via the sling channels 16, 18 engaging the sling rail 32 where the rod 38 is slid into the conduits of the sling channels 16, 18. As such, the rigid backing 50 may be positioned or arranged to not be connected to or directly on (e.g., resting on) the sling channels 16, 18 and consequently, not connected to or resting on the frame 14 of the seating 2.

Figure 12:
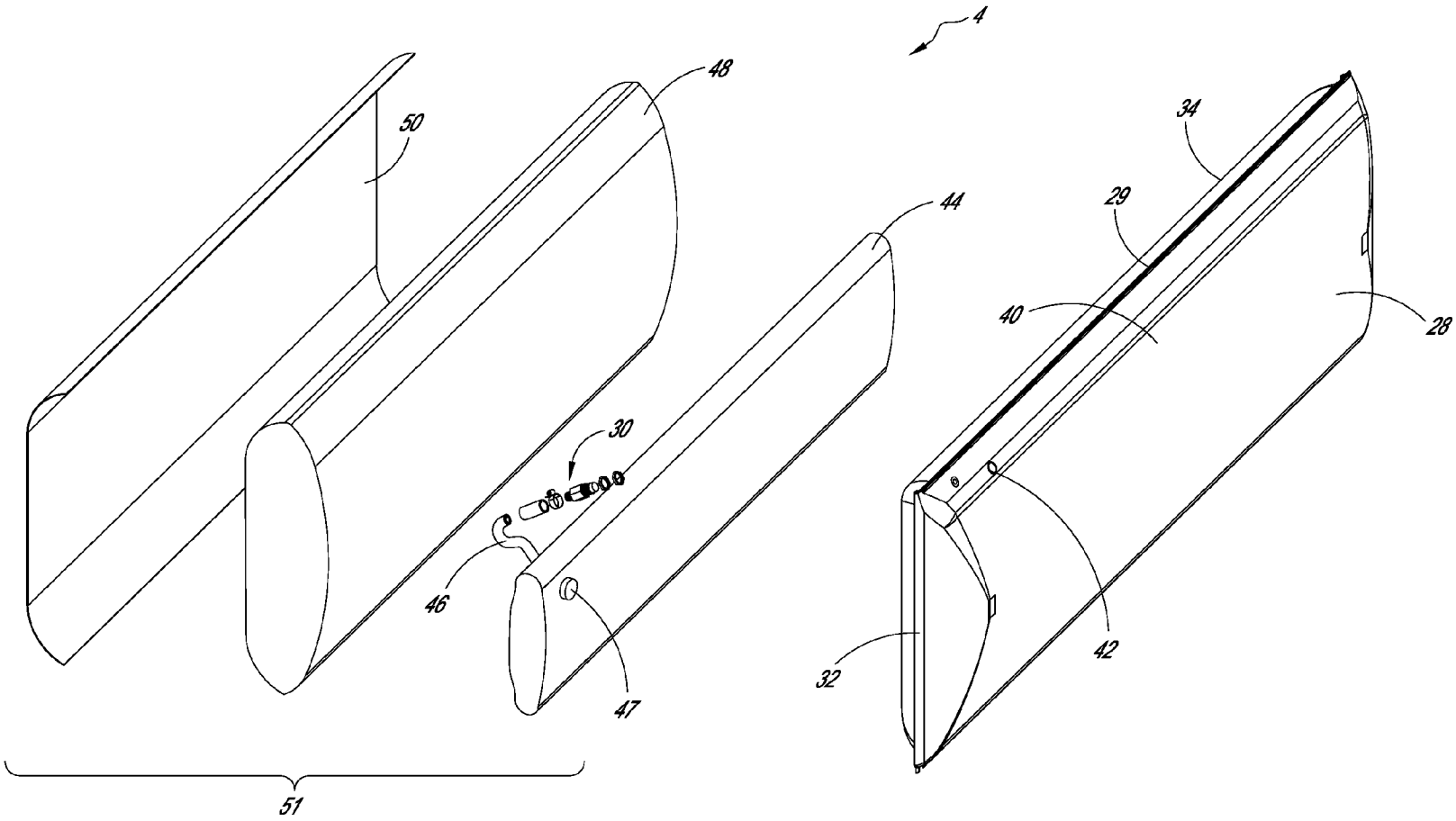
FIG. 12 illustrates a front perspective exploded view of an embodiment of an adjustable cushion.

FIG. 12 illustrates a front perspective exploded view of an embodiment of an adjustable cushion 4. The adjustable cushion 4 can have a casing (e.g., cover, envelope) 40. The casing 40 can include the face 28, seam 29, sling channels 32, and/or back 34 as discussed herein. The casing 40 can have an opening 42 for the valve 30. The opening 42 can be located near an edge or corner of the casing 40 to position the valve 30 at a desirable and easy to reach location. The outside or casing 40 of the adjustable cushion 4 can be formed from pieces of fabric sown together to form the adjustable cushion 4 such as, for example, along seam 29. In some embodiments, the pieces of fabric can be can be joined using any suitable or known process or processes, including permanent adhesive, thermal bonds, ultrasonic bonds, spot welds, i.e., thermal weld points, a stitch or stitches, strip welds, tacks formed by crimping, and so forth, including any combination thereof. The fabric can include rope or netting woven or assembled together to form a desired seating surface. The fabric materials can be made of any suitable natural material, such as cotton, reeds, or leather, and/or artificial materials, such as any suitable polymer compositions, including polyester or synthetic leather. For example, the fabric material can be made from a lightweight strong woven material or from sheets of resinous material such as a plastic material used in fluid mattress or other similar inflatable objects.

The adjustable cushion 4 can have a balloon, pouch, or envelope 44. The envelope 44 can be airtight to encase the internal, resilient, open cell foam 52 (FIG. 14), which is capable of being self-filled from ambient air. The airtight envelope 44 can made from an airtight material such as flexible vinyl polymer material, thin, closed-cell foam, or a fabric having a plastic or rubber-type of lining which is capable of holding low super atmospheric pressure of air when, for example, an occupant applies external pressure to the adjustable cushion 4 while sitting. The material of the envelope 44 can include thermoformed plastic, including polyethylene terephthalate (PET), metalized PET, low-density polyethylene, high-density polyethylene, nylon, polyolefin, blends of polyolefin, polystyrene, blends of polyolefin and polystyrene, polyester, and blends of polyester to attain a desired combination of flexibility and strength. In some embodiments, the adjustable cushion 4 and its components can be made of multiple layers of the materials discussed herein. For example, the envelope 44 may be made of a relatively lightweight plastic that forms a sealable inner balloon or pouch, surrounded by an outer layer of a high strength woven fabric material to form the casing 40. The choice of materials or combination of materials can be sufficiently flexible or pliable to allow folding, creasing, etc., without a substantial loss of strength and fluid sealing ability. The size of the envelope 44 can be determined by the physical size and dimensions of the envelope 44 as well as the size and dimensions of a compressible or adjustable foam 52 inside the envelope 44 (FIG. 14) as discussed herein The envelope 44 can have a tube 46 connected to an opening or port in the envelope 44 to provide a passageway for air into and out of the envelope 44. The tube 46 can be made of the same, similar, or different materials as discussed herein for materials of the envelope 44. The tube 46 can be connected to a valve 30 or components of the valve 30 as discussed herein to provide selective pneumatic access to the envelope 44 via the tube 46.

The envelope 44 can have an automatic pressure release valve 47. The pressure release valve 47 may be a resealing rupture disc/diaphragm or other pressure release valves. The pressure release valve 47 can release pressure within the envelope 44 when the pressure increases beyond a predetermined pressure threshold. The pressure release valve 47 can help prevent rupture of the envelope 44 when, for example, an occupant applies too much pressure on the envelope 44. For example, high pressure within the envelope 44 may occur when the occupant suddenly jumps onto the seating. Conversely, high pressure within the envelope 44 may occur when a person is getting up from the seating and applies a substantial portion of or entire body weight on the envelope 44 with, for example, a hand or elbow.

The adjustable cushion 4 can have a support foam 48. The support foam 48 can be the same or substantially similar in size and shape as the casing 40. The size and shape of the support foam 48 can be varied to achieve a desired shape and feel of the adjustable cushion 4 as discussed herein. The support foam 48 can be closed cell or open cell foam or mesh material as discussed herein. The material can include, for example, polyurethane or vinyl chloride polymer foam, or latex foam rubbers.

The adjustable cushion 4 can have a rigid backing 50. The rigid backing 50 can be a flat panel or board with rounded sides to match the contour of the support foam 48 and/or casing 40. In some embodiments, the rigid backing 50 can be a substantially flat panel without rounded sides when, for example, the back 34 of the casing 40 is substantially flat. The rigid backing 50 can be made of any suitably rigid or semi rigid material to provide the desired support and inhibit tearing or ripping of the fabric/material of the casing 40. The material of the backing 50 can include, for example, polycarbonate, polymethyl methacrylate (PMMA, acrylic), or other polymers such as integrally thermoformed plastic, including polyethylene terephthalate (PET), metalized PET, low-density polyethylene, high-density polyethylene, nylon, polyolefin, blends of polyolefin, polystyrene, blends of polyolefin and polystyrene, polyester, and/or blends of polyester.

In some embodiments, referring to, for example, FIG. 3, the rigid backing 50 can span an entire or substantially entire surface area formed by the sling 7*a* and/or 7*b*. For example, a rigid backing 50 can be formed from a single flat panel covering or nearly covering an area defined by the backrest 3. The adjustable cushions 4*a*, 4*b* and/or non-adjustable cushion 12 can be positioned onto the rigid backing 50. The internal components 51 (minus the rigid backing 50) of the adjustable cushions 4*a*, 4*b* can be positioned on the single piece rigid backing 50 as discussed herein to form the adjustable cushions 4*a*, 4*b*.

Figure 13:
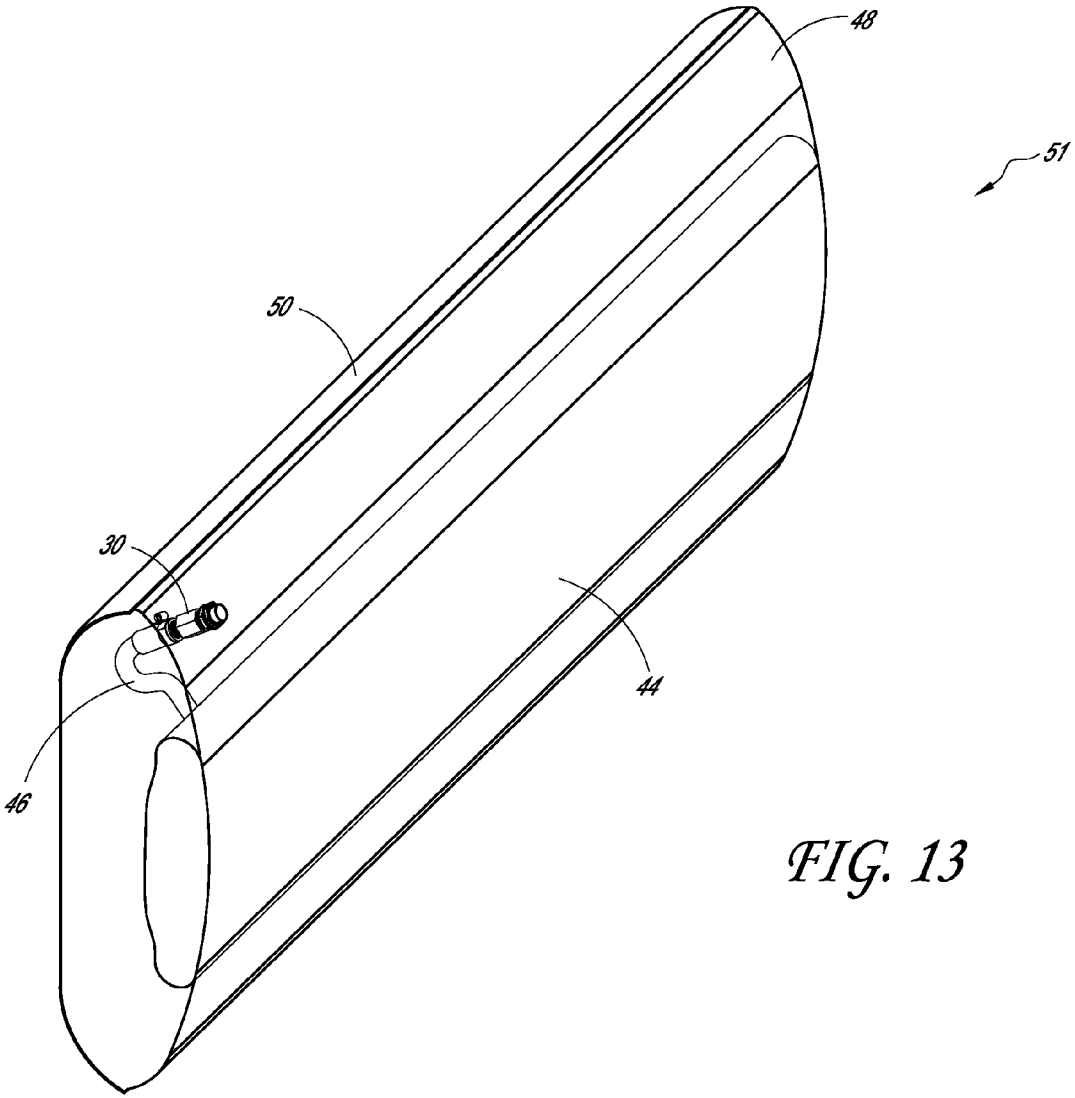
FIG. 13 illustrates a front perspective view of an embodiment of assembled internal components of an adjustable cushion without a casing.

FIG. 13 illustrates a front perspective view of an embodiment of assembled internal components 51 of an adjustable cushion 4 without the casing 40. FIG. 13 illustrates the arrangement of the internal components 51 when placed inside the casing 40 of the adjustable cushion 4. The envelope 44 can be pressed against and at least partially into the support foam 48. FIG. 13 shows the support foam 48 being transparent for illustration purposes. As illustrated in FIG. 13, the envelope 44 can be pressed against the support foam 48 such that a surface of the envelope 44 is flush with a surface of the support foam 48. In some embodiments, the envelope 44 can protrude from the support foam 48 to achieve a desired profile and firmness of the adjustable cushion 4 as discussed herein and in particular, in reference to FIG. 14. The support foam 48 can have an opening or tunnel where material is removed from the support foam 48 to place the tube 46 of the envelope 44 and the valve 30.

A back of the support foam 48 can be at least partially or substantially entirely covered by the rigid backing 50. In some embodiments, the envelope 44 can be at least partially or substantially entirely covered by the rigid backing (e.g., embodiments without a support foam 48). The rigid backing 50 can be formed to a predetermined shape to achieve a desired shape (e.g., profile) of the support foam 48 and/or adjustable foam 52 as well as an overall desired shape of the adjustable cushion 4. Thus, the contact surfaces of the rigid backing 50 and the support foam 48 can intimately nest or follow a generally same contour formed by the rigid backing 50 to achieve a desired shape and support of the adjustable cushion 4. The rigidity and predetermined shape of the rigid backing 50 as well as the arrangement of the internal components 51 of the adjustable cushion 4 as discussed herein can help form a desired shape of the adjustable cushion 4 (e.g., a convex profile that faces the occupant).

Figure 14:
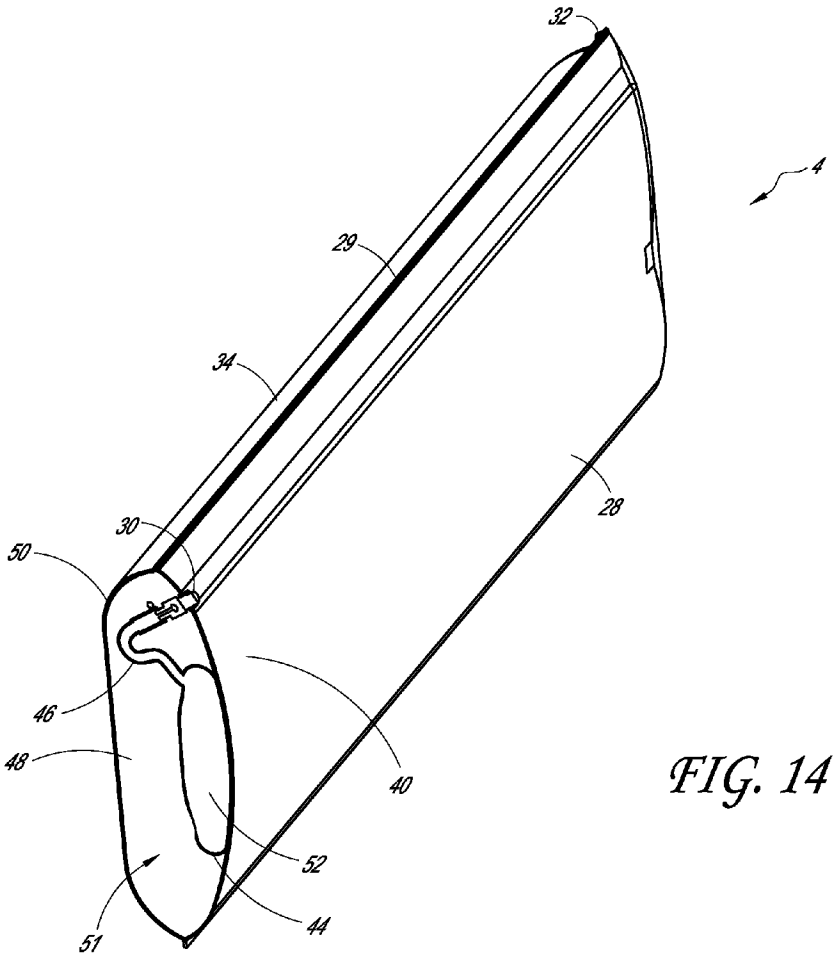
FIG. 14 illustrates a cross-sectional front perspective view of an embodiment of an adjustable cushion.

FIG. 14 illustrates a cross-sectional front perspective view of an embodiment of an adjustable cushion 4. The cross-section is taken at about the location of the valve 30 within the adjustable cushion 4. The arrangement of the internal components 51 within the casing 40 can substantially be as discussed herein and in particular, in reference to FIG. 13. A back surface of the rigid backing 40 can directly contact the sling fabric of the casing 40. The fabric of the casing 40 can generally intimately wrap the rigid backing 50, following the contour of the rigid backing 50, to form a desired shape of the adjustable cushion 40. As illustrated in FIG. 14, the rigid backing 50 can have a shape with a flat middle portion and rounded sides that the casing 40 mirrors. In some embodiments, the rigid backing 50 can be substantially flat along seam 29 as discussed herein. The rigid backing 50 can help prevent or inhibit tearing or ripping of the sling fabric by keeping the sling fabric at a desired shape during weight bearing circumstances (e.g., when an occupant is in the seating). The casing 40 can be substantially flat along seam 29 (i.e., when the backing 50 is substantially flat) to form a sling for a seating as discussed herein. The support foam 48 can rest against the rigid backing 50 to at least partially fill the internal cavity of the casing 40 to help form the shape of the adjustable cushion 4.

The envelope 44 can have an adjustable foam or mesh 52. The adjustable foam 52 may include open cell polyurethane or vinyl chloride polymer foam, or latex foam rubbers. The resilient and pliable material can have interconnected, internal, open cells through which air may pass, thereby permitting release or acquisition of air by the adjustable foam 52 as it is compressed or expanded. The material of the foam 52 can be compressed into a smaller volume when the fluid (e.g., air) within the open (fluid permeable) cells is squeezed out of the cells. Thus, when air is removed from the envelope 44 and the valve 30 is closed, the adjustable foam 52 is in a low pressure, partial vacuum state after the release of the compressive force applied to expel air from the envelope 44.

When the valve 30 is opened and a compressive force is not applied to the envelope 44 in a partial vacuum state, the ambient are pressure (or atmospheric pressure) causes air to return to the pliable cells of the adjustable foam 52, having a relative low pressure due to the earlier removal of air, thereby causing the adjustable foam 52 material to expand in volume. With the expanded foam material of the adjustable foam 52 being in an airtight envelope 44, which prevents air from escaping from the volume occupied by the adjustable foam 52, the composition of the adjustable foam 52 and hermetically sealable envelope 44 creates a fluid (e.g., air) cushion that can later be again unsealed and compressed to achieve a smaller thickness of the adjustable foam 4 or can be further inflated by opening the valve 30 to allow more air into the cells of the adjustable foam 52 to achieve a larger thickness.

Stated differently, to operate the adjustable support cushion 4, an occupant may exert a force against the adjustable cushion 4 by his back, shoulders, neck or hands while simultaneously opening the air control valve 30. The compression of the open cell formed filler material of the adjustable foam 52 will force excess air out through the valve 30. Then, upon closing the valve 30, air will be precluded from reentering the cells of the foam type filler material of adjustable foam 52 or the airtight envelope 44, and the adjustable cushion 4 will remain at the desired thickness. Conversely, through the utilization of an internally positioned resilient foam material of the adjustable foam 52, the removal of a compressive force against the adjustable cushion 4, and the simultaneous opening of the control valve 30, will permit the inherent resilience of the foam material of the adjustable foam 52 to cause the envelope 44 to expand outwardly, drawing air into filler material open cells, thereby returning to the original shape of the adjustable cushion 52 or any desired shape in between.

The density and size of the support foam 48 and the adjustable cushion 52 can be varied to achieve a desired shape, thickness, and/or support of the adjustable cushion 4. In some embodiments, the density of the support foam 48 is at least partly based on the size of the envelope 44 and/or adjustable cushion 52. The larger the envelope 44 and/or adjustable cushion 52, the less dense the support foam 48 may be. The smaller the envelope 44 and/or adjustable cushion 52, the denser the support foam 48 may be. In some embodiments, the size of the support foam 48 is at least partly based on the density of the adjustable cushion 52. The denser the adjustable cushion 52, the larger the support foam 48 may be. The less dense the adjustable cushion 52, the smaller the support foam 48 may be. In some embodiments, the size and/or density of the support foam 48 is at least partly based on the size and/or density of the adjustable cushion 52. The larger the adjustable cushion 52, the smaller the support foam 48 may be. The smaller the adjustable cushion 52, the larger the support 48 may be. The denser the adjustable cushion 52, the less dense the support foam 48 may be. The less dense the adjustable cushion 52, the denser the support 48 may be. The size and density of the support foam 48 can be designed to cause the adjustable foam 52 to project toward the occupant to achieve a desired shape, thickness, and/or support of the adjustable cushion 4 as discussed herein. For example, a larger and/or denser support foam 48 can be used to achieve a more convex shape, a further projection (thickness) toward the occupant, and a stiffer/firmer support. A smaller and/or less dense the adjustable foam 52 can be used with a larger and/or denser the support foam 48 and vice versa. For example, where more adjustability in the thickness and support of the adjustable cushion 4 is desired, a larger and/or less dense adjustable foam 52 may be used with a smaller and/or denser support foam 48. Where less adjustability in the thickness and support of the adjustable cushion 4 is desired (e.g., to keep the shape and thickness of the adjustable cushion 4 relatively constant), a smaller and/or denser adjustable foam 52 may be used with a larger and/or less dense support foam 48.

In some embodiments, the resilience and/or cushioning of the adjustable cushion 4 may be provided entirely or substantially entirely by the support foam 48 and/or adjustable foam 52. In some embodiments, other internal spring devices may be used to provide resiliency to the adjustable cushion 4. The internal spring devices can be used in conjunction with the resiliency provided by the support foam 48 and/or adjustable foam 52. For example, steel or reinforced resin material or tubing with reinforcing filament wound glass fibers may be placed in the fabric of the casing 40 and/or envelope 44. The internal spring devices can be elliptically shape to achieve a desired (e.g., convex) shape of the adjustable cushion 4 and/or provide desired collapsing and expansion features as discussed herein. As another example, internal stiffeners can be placed inside the cavity of the airtight envelope 44 through or by the adjustable foam 52. The internal stiffeners can help uniformly distribute pressure against the adjustable foam 52 and can help with retention of the contour adjustable cushion 4.

In some embodiments, the adjustable foam 42 can be attached to the airtight envelope 44. Attaching the adjustable foam 52 to the envelope 44 can help retain a desired shape of the adjustable cushion 4 upon application of external pressure by, for example, preventing bulging of the adjustable foam 52 in certain parts of the adjustable cushion 4. In some embodiments, the adjustable foam 52 can be partially or not attached to the envelope 44. Not attaching the adjustable foam 52 to the envelope 44 can help redistribute pressures applied to the adjustable cushion 4. Further, shear forces between the adjustable foam 52 and the envelope 44 can be reduced upon application of external pressure to extend the useable life of the adjustable foam 52. A balance between attaching and not attaching the adjustable foam 52 to the envelope 44 can be achieved for a desired shape and functionality of the adjustable cushion 4 as discussed herein.

Figure 15:
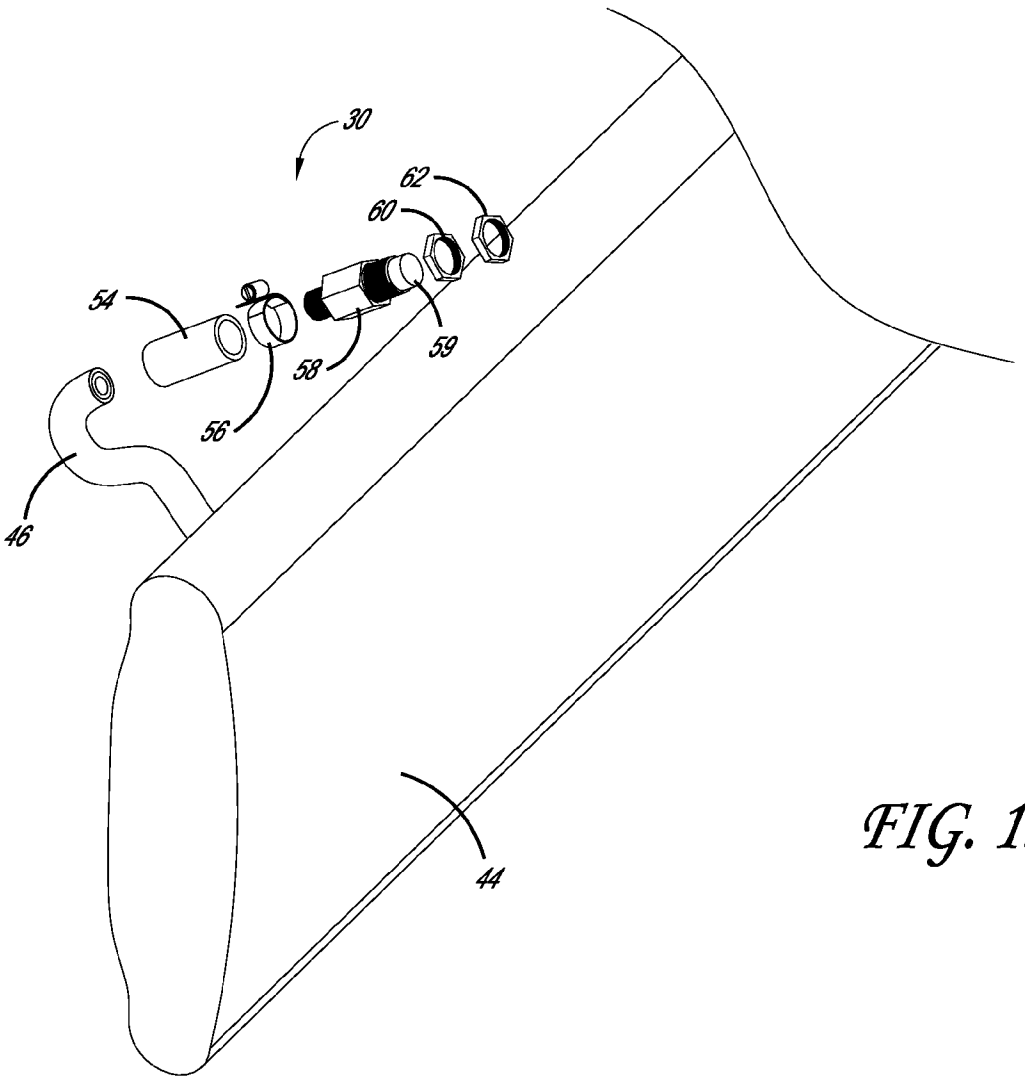
FIG. 15 illustrates a front perspective exploded view of an embodiment of an air control valve.

FIG. 15 illustrates a front perspective exploded view of an embodiment of an air control valve 30. The valve 30 can have a fitting 54 that can be connected to the tube 46 of the envelope 44. In some embodiments, the fitting 54 can overlap the tube 46 and be secured to the tube 46 with adhesive, clamping, threading, and/or an interference fit, or any other suitable attachment mechanism as discussed herein.

The valve 30 can have a switch 58. The switch 58 can have a push button 59. The switch 58 can regulate air flow through the valve. The switch 58 can be spring biased to a closed position. The push button 59 can be depressed to open the switch 58 and allow air to flow through the valve 30 into and out of the envelope 44 via the tube 46. The switch 58 can have a ball-check valve and/or an O-ring to create a desired airtight seal. An end of the switch 58 can be connected to the fitting 54. In some embodiments, the switch 58 can be connected directly to the tube 46. The fitting 54 can overlap the switch 58 and be secured with adhesive, clamping, threading, and/or an interference fit, or any other suitable attachment mechanism as discussed herein. As illustrated in FIG. 15, one or more clamps 56 can overlap the fitting 54. When tightened, the clamp 56 can securely hold the tube 46 and/or switch 58 to provide substantially airtight fluid communication between the tube 46 and the switch 58.

The switch 58 can be threaded to allow for connections with the tube 46, fitting 54, and/or other internal components 51. The switch 58 can be threaded to mate with a first nut 60 and a second nut 62. When the switch 58 is inserted through the opening 42 of the casing 40 (FIG. 12), the switch 58 can be secured to the opening 42 with the first and second nuts 60, 62 where the first and second nuts 60, 62 tighten against a surface of the face 28 of the casing 40. Two nuts can be used such that the first and the second nuts 60, 62 are tightened against each other to provide a more secure connection. The same or similar air control valve 30 and connections can be applied to a valve 30 positioned in an armrest of a seating as discussed in reference to FIG. 1.

Valves for Controlling Fluid Flow, Including Airflow

Figure 16:
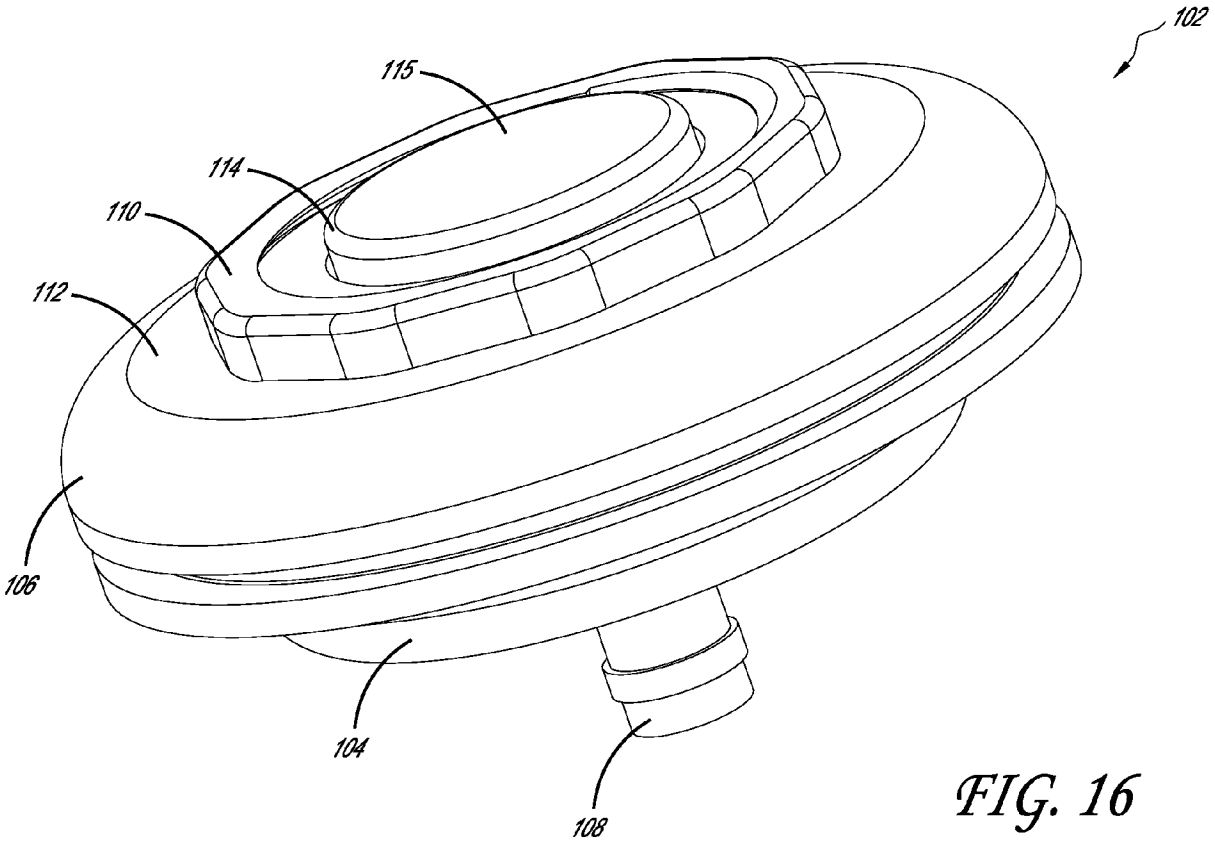
FIG. 16 illustrates a perspective view of an embodiment of a valve.

FIG. 16 illustrates a perspective view of an embodiment of a valve 102. The valve 102 can be an air valve or other fluid-type valve for selectively controlling fluid (e.g., air) flow. In some embodiments, the valve 102 can be used to operate (e.g., inflate and deflate) adjustable cushions 4 as discussed herein, including operation of the air control valve 30. The valve 102 can be positioned in, for example, armrests 9 and/or an adjustable cushion 4 as discussed herein. The adjustable cushion 4 and valve combinations discussed herein can be used with, for example, seating 2 as discussed herein and/or can be an adjustable cushion 4 that is not attached to a seating 2 (e.g., a throw pillow used in any desired location, including on top of seating 2).

As illustrated in FIG. 16, the valve 102 can have a bottom (e.g., body or base) 104 and a cap (e.g., nut or dome) 106. The bottom 104 can have a nozzle (e.g., tube or cylinder) 108 that allows fluid to flow in the tube 108 as discussed herein. The cap 106 can have a cap boss 110 that rises above a cap surface 112 of the cap 106. The valve 102 can have a button or push-button (e.g., actuator) 114. The button 114 can be considered an actuator for the valve to function 102 as discussed herein. The button 114 can have an actuator surface 115. A user can press on the actuator surface 115 of the button 114 to depress the button 114. The button 114 can be moved and/or depressed to selectively control fluid flow through the valve 102 as discussed herein.

The cap boss 110 can be a shape designed to engage a tightening tool (e.g., a wrench or other torqueing tool). For example, the cap boss 110 can have a shape being a decagonal as illustrated in FIG. 16. In some embodiments, the cap boss 110 can have a shape being any polygon, including an octagonal, hexagonal, tetragonal, and/or the like to engage a tightening tool to tighten (e.g., twist) the cap 106 onto a component of the valve 102 as discussed herein. In some embodiments, the cap 106 can have a shape as discussed herein to engage a tightening tool to tighten the cap 106 onto a component of the valve 102.

As illustrated in FIG. 16, the valve 102 can be generally round. In some embodiments, the valve 102, including any of its components, can be of a different shape (e.g., any polygonal or round shape as discussed herein) to facilitate tightening the valve 102, components of the valve 102, and/or positioning the valve 102. Other components of the valve 102 as discussed herein can be round about the central axis or any other suitable shape for the functionality of a low profile valve as discussed herein. For example, the nozzle 108 can have a nozzle boss connected to the bottom 104. The nozzle boss can be connected to or protruding from the bottom 104 with the nozzle 108 connected to the nozzle boss. The nozzle boss can be decagonal, octagonal, hexagonal, tetragonal, and/or the like to engage a tightening tool to tighten (e.g., twist) the bottom 106 onto a component of the valve 102. For example, both the bottom boss and the cap boss 110 can be shaped to engage to a tightening tool such that the bottom 104 and cap 106 are tightened simultaneously onto each other and/or other parts of the valve 102. In some embodiments, a part of the nozzle 108 can be shaped to engage a tightening tool as discussed herein.

Figure 17A:
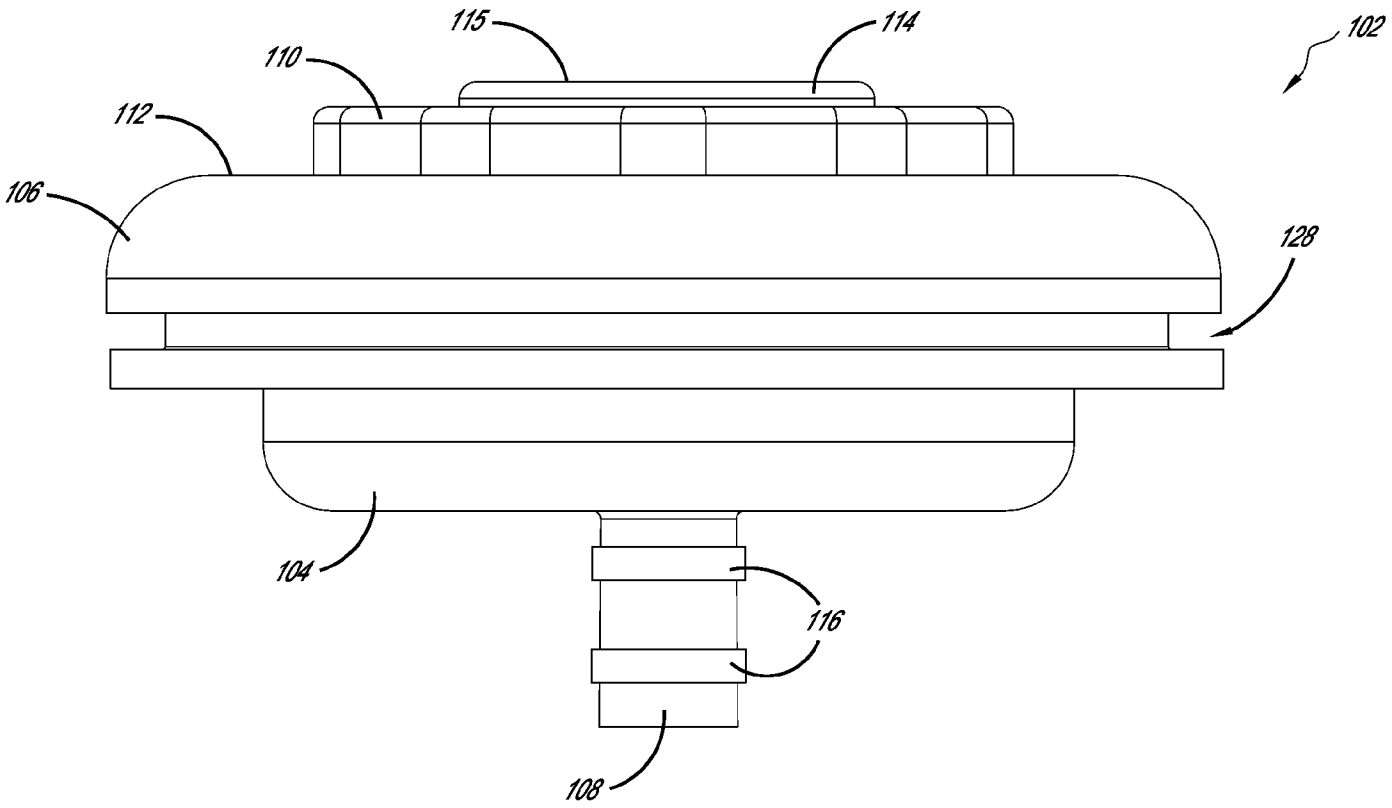
FIG. 17A illustrates a side view of an embodiment of a valve.

FIG. 17A illustrates a side view of an embodiment of a valve 102. The button 114 can be substantially flush with the cap boss 110 when the button (e.g., actuator) 114 biased in the first direction 170 (see FIG. 21). In some embodiments, the valve 102 may not have a cap boss 110, and the button 114 (e.g., button surface 115) can be substantially flush with the cap surface 112 of the cap 106. As illustrated FIG. 17A, the button surface 115 may protrude slightly past the cap boss 110 to, for example, provide a contour for easy feel and operation of the valve 102 by a user.

The cap 106 can have a low profile relative to or be substantially flush with, for example, a face (e.g., front) 28 of an adjustable cushion 4 as discussed herein. The cap 106 (and correspondingly the valve 102) having a low profile or being flush with face 28 can help prevent the valve 102 from being a prominent feature (e.g., the cap 106, cap boss 110, and/or button 114) to avoid accidental depression of the button 114 and improve aesthetic appeal as well as safety and reliability of the valve 102 relative to any desired surface. Simultaneously, the button 114 can provide easy access (i.e., easily reachable by a user) and operation of the valve 102.

The nozzle 108 can be sized for a tube 46 of an envelope 44 as discussed herein to fit over the nozzle 108 and provide selective fluid access to the envelope 44 via the tube 46. The nozzle 108 and tube 46 can be correspondingly sized such that the tube 46 is securely engaged and/or mated with the nozzle 108 to remain in position relative to the nozzle 108. The nozzle 108 and tube 46 can form a substantially fluid tight (e.g., airtight) connection and/or seal.

As illustrated in FIG. 17A, the nozzle 108 can have one or more tracks (e.g., annular projections, rings, or strips)

116. The tracks 116 can protrude past an outer surface of the nozzle 108. The tracks 116 can engage the tube 46 to form a fluid tight seal. For example, the tube 46 can be elastic and when stretched over the tracks 116 beyond stretching over a surface of the nozzle 108, the fluid tight seal is reinforced. In some embodiments, a clamp 56 as discussed herein can overlap the tube 46 when positioned onto the nozzle 108. The clamp 56 can be positioned, for example, between the two tracks 116 illustrated in FIG. 17A. When tightened, the clamp 56 can securely hold the tube 46 on the nozzle 108 to provide substantially leak free (e.g., inhibiting or preventing fluid leaks) fluid communication between the tube 46 and the valve 102.

Figure 18:
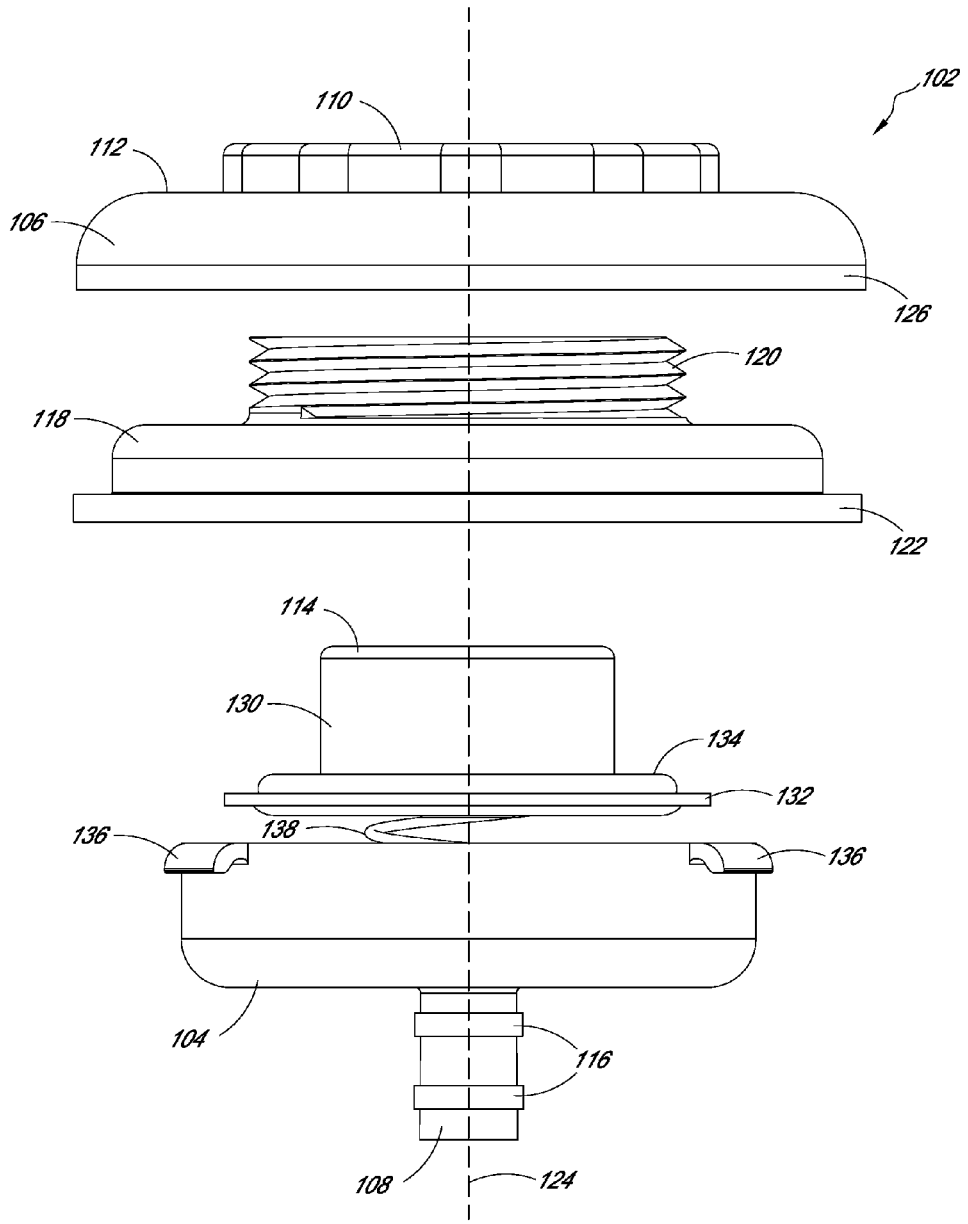
FIG. 18 illustrates an exploded side view of an embodiment of a valve.

FIG. 18 illustrates an exploded side view of an embodiment of the valve 102. The valve 102 can have a hub (e.g., top, cover) 118. The hub 118 can have a hub boss 120. The hub boss 120 can be, for example, threaded to connect with the cap 106. The cap 106 and/or cap boss 110 can be correspondingly threaded to engage and/or mate with the hub 118. For example, the cap 106 can be twisted into a desired position onto and relative to the hub 118.

The hub 118 can have a hub flange (e.g., lip) 122. The hub flange 122 can circumscribe the hub 118 (e.g., a base of the hub 118) about a central axis 124 of the valve 102. The central axis 124 can be a center axis for the bottom 104, the cap 106, the hub 118, spring 138, and/or the plug 130. The central axis 124 can be a center axis about which a component of the valve 102 is centered on (e.g., a radial center point for a circular component of the valve 102). For example, as illustrated in FIG. 18, the bottom 104, the cap 106, the hub 118, the spring 138, and plug 130 are concentric with each other and centered on the central axis 124.

Per the illustration of FIG. 18, where the reference line of reference number 118 of the hub 118 leads to can generally be considered to be a base of the hub 118. The hub flange 122 can extend radially outward from the central axis 124. In some embodiments, the hub flange 122 can extend at angle relative to the central axis 124 or can have a part that extends at angle relative to the central axis 124. In some embodiments, the hub flange 122 can extend along (e.g. substantially parallel to) the central axis 124, as for example, illustrated and discussed in reference to a cap lip 126.

The cap 106 can have a cap lip (e.g., flange) 126. The cap lip 126 can circumscribe the cap 106 (e.g., a base of the cap 106) about the central axis 124. Per the illustration of FIG. 18, where the reference line of reference number 106 of the cap leads to can generally be considered to be a base of the cap 106. The cap lip 126 can extend along (e.g. substantially parallel to) the central axis 124. As illustrated, the cap lip 126 can extend in a direction generally toward the hub 118 and/or hub flange 122. In some embodiments, the cap lip 126 can extend radially outward from the central axis 124, as for example, illustrated and discussed in reference to the hub flange 122. In some embodiments, the cap lip 126 can extend at angle relative to the central axis 124 or can have a part that extends at angle relative to the central axis 124.

When the cap 106 is connected, secured, and/or attached to the hub 118, the cap lip 126 and the hub flange 122 can form a channel (e.g., a duct) 128 as illustrated in FIG. 17A. The channel 128 can be sized to engage and/or mate with a casing (e.g., cover, envelope) 40 of the adjustable cushion 4 when the valve 102 is inserted into the opening 42 as discussed herein. For example, as the cap 106 is rotated onto the hub 118 via the correspondingly threaded cap boss 110 and hub boss 120, the channel 128 can get smaller in a dimension along the central axis 124 to clamp down on a material or fabric of the casing 40 as discussed herein and in particular, as discussed in reference to the nuts 60, 62 of the valve 30. The materials or fabric can be any suitable (e.g., durable and/or elastic) material as discussed herein to protect, for example, the envelope 44 and position the valve 102 in a desired and/or predetermine position relative to the casing 40 and/or envelope 44.

Figure 17B:
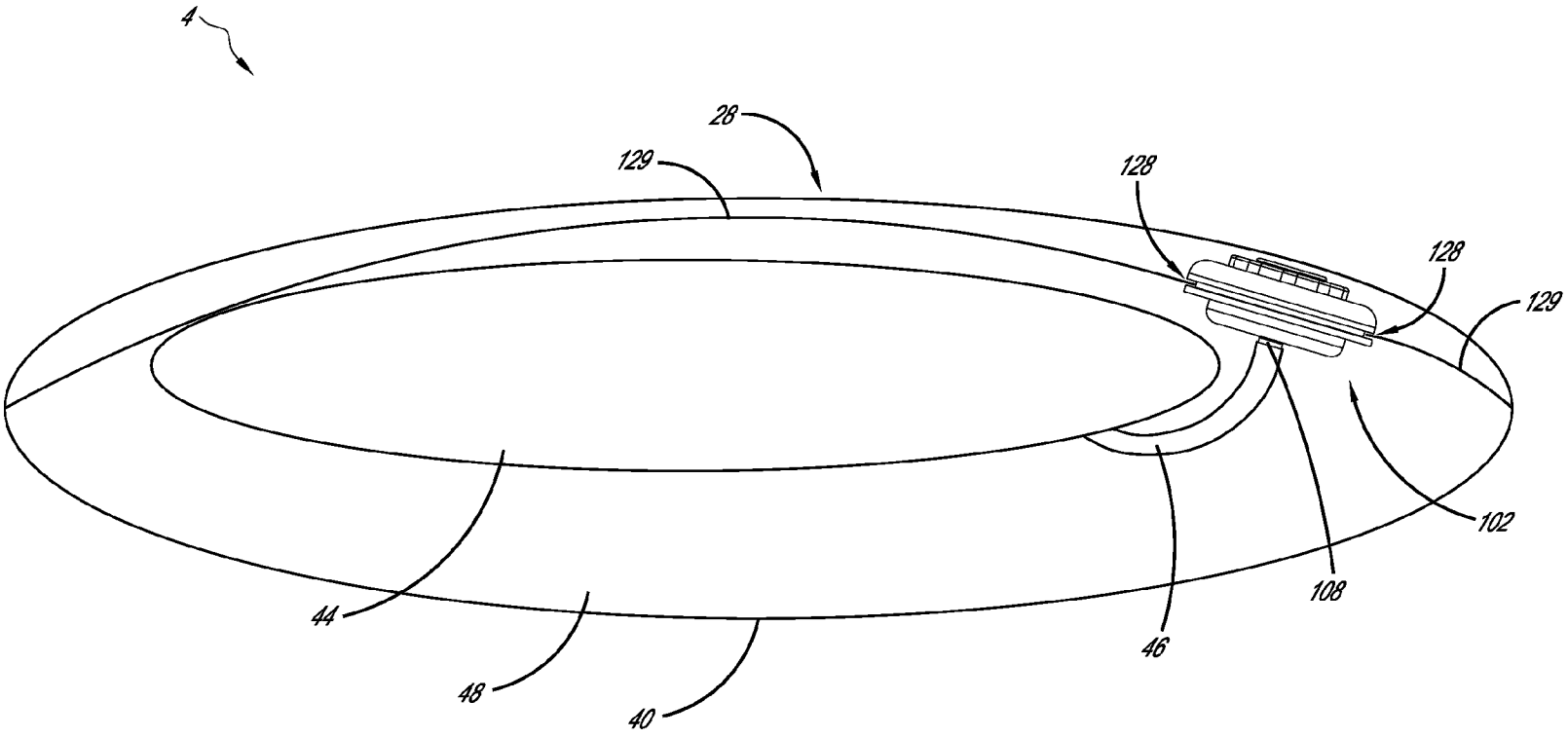
FIG. 17B illustrates a cross-sectional side view of an embodiment of an adjustable cushion with a valve.

FIG. 17B illustrates a cross-sectional side view of an embodiment of an adjustable cushion 4 with a valve 102. The cushion 4 can be used with, for example, seating 2 (e.g., attached to seating 2) as discussed herein and/or can be used as, for example, a throw pillow to be placed in any desired location without being attached or directly attached to seating 2. The cushion 4 can have a casing 40, an airtight envelope 44, a tube 46, and/or support foam 48 as discussed herein. The tube 46 can be connected to the valve 102 via the nozzle 108 as discussed herein. In some embodiments, the casing 40 (with or without a support sheet 129 as discussed herein) can be enclosed inside and/or housed in another casing, cover, or envelope made of the same or different material as the casing 40. The another casing enclosing the casing 40 can be a textile material providing a desired feel and/or aesthetic look to the adjustable cushion 4.

As illustrated in FIG. 17B, the valve 102 can be positioned inside the cushion 4 (e.g., internally or within the casing 40). As such, the valve 102 can remain hidden within the casing 40. At least a part of the material of the casing 40 can be permeable to fluid flow (e.g., airflow) to allow fluid flow (e.g., ambient air external to the casing 40) through the valve 102 as discussed herein. The low profile features of the valve 102 discussed herein can allow the valve 102 to be positioned within the casing 40 without protruding or substantially without protruding from the casing 40 or periphery of the casing 40. With the valve 102 positioned internally in the casing 40, the valve 102 may not or may minimally detract from desired aesthetics of the cushion 4 (e.g., a pattern on the casing 40 is not interrupted by the valve 102 on the face 28 of the casing). Concomitantly, the valve 102 can be positioned near the external material of the casing 40 (e.g., near the face 28 of the casing 40) to facilitate ease of use (e.g., depressing button 114 to allow fluid flow substantially without hindrance from, for example, support foam 48), as well as facilitate ease of finding the valve 102 hidden within the casing 102 in order to operate the valve 102.

The cushion 4 can have a support sheet 129 positioned within the casing 40 to support and/or position the valve 102 in a desired and/or predetermined position. The support sheet 129 can have an opening for the valve 102 (e.g., same or similar to an opening 42 of the casing 40 discussed herein). The opening of the support sheet 129 can be located near an edge or corner of the casing 40 to position the valve 102 at a desirable, easy to reach, and known location. The channel 128 of the valve 102 can connect, engage, and/or mate with (e.g., clamp) the material of the support sheet 128 as discussed herein to position the valve 102 as desired.

The support foam 48 can be positioned in the casing 40 around the envelope 44, support sheet 129, tube 46, and/or valve 102 to maintain desirable and/or predetermined positions (e.g., relative positions) of the envelope 44, support sheet 129, tube 46, and/or valve 102 in the casing 40. In some embodiments, the valve 102 can be connected to the envelope 44 directly without, for example, a tube 46. In some embodiments, the valve 102 can be positioned within the casing 40 without the support sheet 129. For example, the valve 102 can be connected to the envelope 44 via the tube 46 and at least partially surrounded and/or enclosed by the support foam 48 in a desired position. The support foam 48 can be of similar or greater density around or near the valve 102 to substantially maintain a desired position of the valve 102 within the foam 48 relative to the casing 40.

The support sheet 129 can be connected to the casing 40 with any suitable attachment mechanism as discussed herein. For example, the support sheet 129 can be attached to the outside or casing 40 when the casing 40 is being formed from pieces of fabric sown together to form the adjustable cushion 4 such as, for example, along seam 29 as discussed herein. The support sheet 129 can be attached to the casing 40 at any other suitable connection points with the casing 40 (e.g., directly to the material forming the face 28 of the casing 40) to position the valve 102 as desired. In some embodiments, the pieces of fabric (e.g., of the casing 40 and support sheet 129) can be can be joined using any suitable or known process or processes, including permanent adhesive, thermal bonds, ultrasonic bonds, spot welds, i.e., thermal weld points, a stitch or stitches, strip welds, tacks formed by crimping, and so forth, including any combination thereof. The fabric of the casing 40 and/or support sheet 129 can include rope or netting woven or assembled together to form a desired seating surface. The fabric materials of the casing 40 and/or support sheet 129 can be made of any suitable natural material, such as cotton, reeds, or leather, and/or artificial materials, such as any suitable polymer compositions, including polyester or synthetic leather. For example, the fabric material of the casing 40 and/or support sheet 129 can be made from a lightweight strong woven material or from sheets of resinous material such as a plastic material used in fluid mattress or other similar inflatable objects. In some embodiments, the casing 40 or part of the casing 40 and the support sheet 129 can be formed from a single piece (e.g., sheet) of material.

Returning to FIG. 18, the valve 102 can have a plug (e.g., a disc) 130. The plug 130 can have a button 114 as discussed herein. The plug 130 can have a plug flange (e.g., lip) 132. The plug flange 132 can circumscribe the plug 130 (e.g., a base of the plug 130) about the central axis 124. Per the illustration of FIG. 18, where the reference line of reference number 130 of the plug 130 leads to can generally be considered to be a base of the plug 130. The plug flange 132 can extend radially outward from the central axis 124. In some embodiments, the plug flange 132 can extend at angle relative to the central axis 124 or can have a part that extends at angle relative to the central axis 124. In some embodiments, the plug flange 132 can extend along (e.g. substantially parallel to) the central axis 124, as for example, illustrated and discussed in reference to the cap lip 126. The plug flange 132 can house, engage, mate with, and/or position a plug gasket 134 (e.g., an O-ring gasket) at a desired and/or predetermine position to form a fluid tight seal with the hub 118 as discussed herein. The plug flange 132 can form a peripheral seal (with or without the plug gasket 134) to stop, prevent, or inhibit fluid flow through the valve 102 as discussed herein (e.g., fluid tight seal with the hub 118).

With continued reference to FIG. 18, the bottom 104 can have projections (e.g., protrusions, fins, fingers, tongues) 136 to connect, engage, and/or mate with the hub 118 to, for example, position the bottom 104 and the hub 118 at fixed positions relative to each other along the central axis 124. A projection 136 can be positioned about the bottom 104 (e.g., a base of the bottom 104) about the central axis 124. Per the illustration of FIG. 18, where the reference line of reference number 104 of the plug 104 leads to can generally be considered to be a base of the bottom 104. The projection 136 can extend radially outward from the central axis 124. In some embodiments, the projection 136 can extend at angle relative to the central axis 124 or can have a part that extends at angle or parallel relative to the central axis 124 as discussed herein. When the bottom 104 and the hub 118 are connected as discussed herein, the valve 102 can have a spring 138 that biases the plug 130 toward the hub 118 in the first direction 170 (see FIG. 21). The spring 138 can be a resilient element/member made of any suitable elastic material able to bias the plug 130 and able to be deformed for the plug 130 to move as discussed herein.

Figure 19:
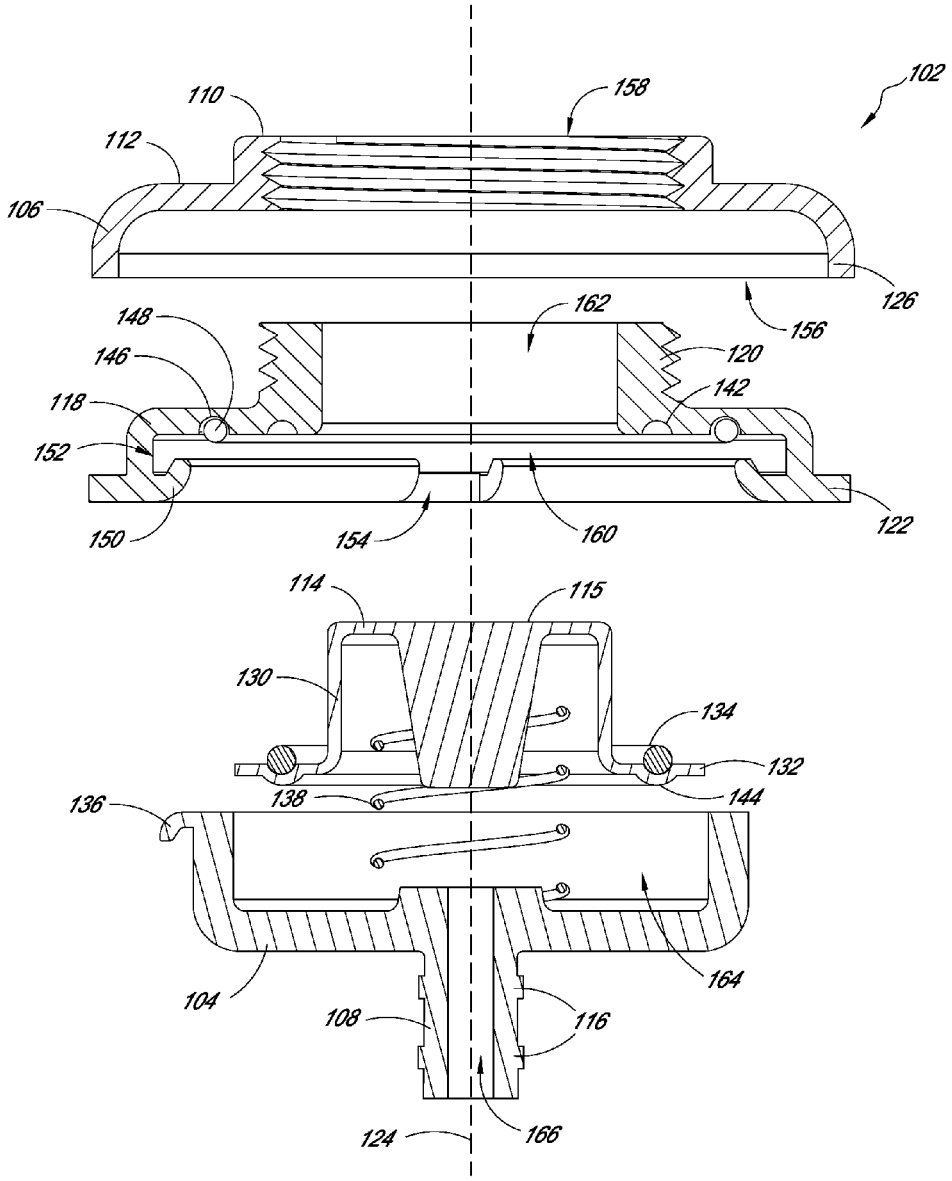
FIG. 19 illustrates a cross-sectional exploded side view of an embodiment of a valve.

FIG. 19 illustrates a cross-sectional exploded side view of an embodiment of the valve 102. As illustrated in FIG. 19, the cap boss 110 can be correspondingly threaded to engage a threaded hub boss 120.

As illustrated in FIG. 19, the hub 118 can have a first gasket groove (e.g. indentation, recesses, channel, seat, seal surface) 142. The first gasket groove 142 can be formed in the hub 118 (e.g., base of the hug 118). The first gasket groove 142 can correspond the plug gasket 134 to form a fluid tight (e.g., airtight) seal between the hub 118 and the plug 130 when the plug 130 is biased against the hub 118 by, for example, the spring 138. As the plug 130 is biased against the hub 118, the plug flange 132 is correspondingly biased against the hub 118. The plug gasket 134 can be biased into the first gasket groove 142 to form a fluid tight seal, inhibiting and/or preventing fluid flow at the contact/engagement surface between the first gasket groove 142 and the plug gasket 134 as well as a plug gasket groove 144.

Correspondingly, the plug 130 can have a plug gasket groove (e.g. indentation, recesses, channel, seat) 144 to house, engage, and/or position the plug gasket 134. The plug gasket groove 144 can be formed in the plug flange 132, for example. In some embodiments, the plug gasket 134 can be adhered with any suitable adhesive or other attachment mechanism to the plug gasket groove 144 for the plug gasket 134 to move with the plug 130 when the plug 130 is moved along the central axis 124 as discussed herein. In some embodiments, the first gasket groove 142 of the hub 118 can house, engage, and/or position the plug gasket 134. The plug gasket 134 can be adhered with any suitable adhesive or other attachment mechanism to the first gasket groove 142 for the plug gasket 134 to remain against the first gasket groove 142 while the plug 130 is moved along the central axis as discussed herein.

As illustrated in FIG. 19, the hub 118 can have a second gasket groove (e.g. indentation, recesses, channel, seat, seal surface) 146. The second gasket groove 146 can be formed in the hub 118 (e.g., base of the hug 118) about a periphery of the hub 118 (e.g., a periphery of the fluid chamber 168, see FIG. 20). The second gasket groove 146 can house, engage, and/or position a hub gasket 148 (e.g., an O-ring gasket). The hub gasket 148 can correspond to a periphery or an end (e.g., base) of the bottom 104 (see FIGS. 20-22) to form a fluid tight (e.g., airtight) seal between the hub 118 and the bottom 104 when the hub 118 and the bottom 104 are connected, engaged, and/or mated as discussed herein to form a fluid tight seal, inhibiting and/or preventing fluid flow at the contact surface between the second gasket groove 146 and the hub gasket 148 as well as an engagement surface with the bottom 104.

As illustrated in FIG. 19, the hub 118 can have a hub flange 122 that extends outwardly or radially outward relative to the central axis 124. The hub 118 can have a conduit flange 150 that extends at least partially inwardly or radially inward relative to the central axis 124. As illustrated in FIG. 19, the conduit flange 150 can extend toward the central axis 124 at angle at least partially in the first direction 170 (see FIG. 21) as discussed herein. The conduit flange 150 can generally form a shape of, for example, a hook, fin, finger, etc. to correspond to the projections 136 of the bottom 104 and to engage the projections 136 as discussed herein. The conduit flange 150 can circumscribe the hub 118 (e.g., a base of the hub 118) about the central axis 124.

Figure 24A:
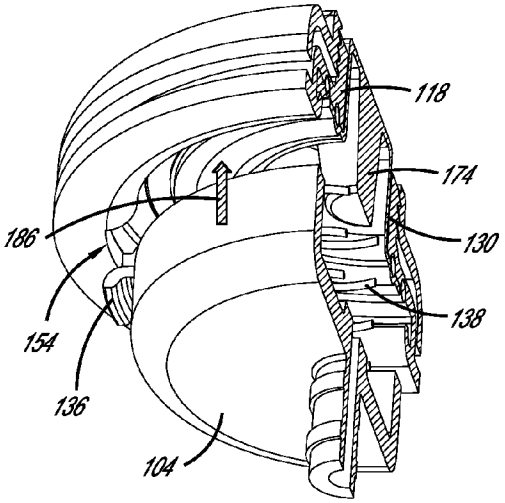
FIGS. 24A-C illustrate an example assembly method for a valve.
Figure 24B:
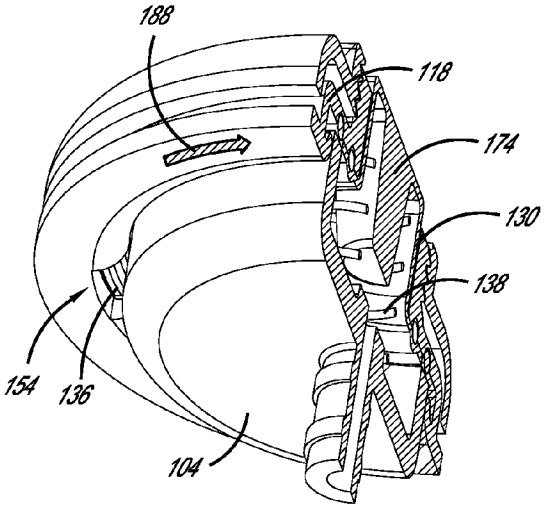
Figure 24C:
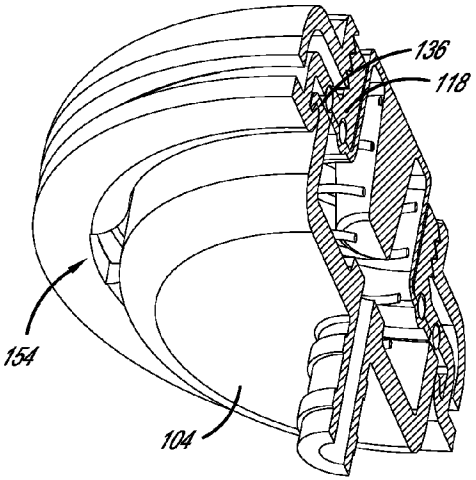

The conduit flange 150 can form a conduit (e.g., a duct) 152 to engage the projections 136 as discussed herein (see FIGS. 24A-C). The conduit flange 150 can have cutouts (e.g. openings) 154 sized and shaped to receive the projections 136 therethrough. When the projections 136 clear the cutouts 154, the bottom 104 and/or hub 118 can be rotated to assemble the valve 102 as discussed herein.

Figure 20:
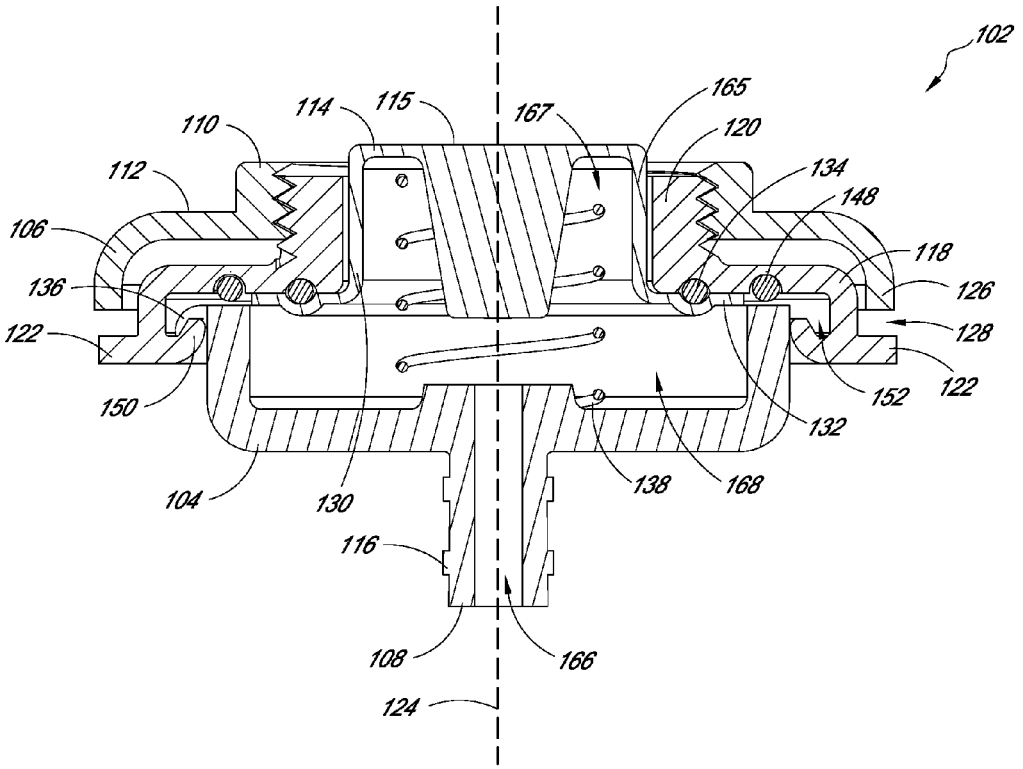
FIG. 20 illustrates a cross-sectional side view of an embodiment of a valve.
Figure 21:
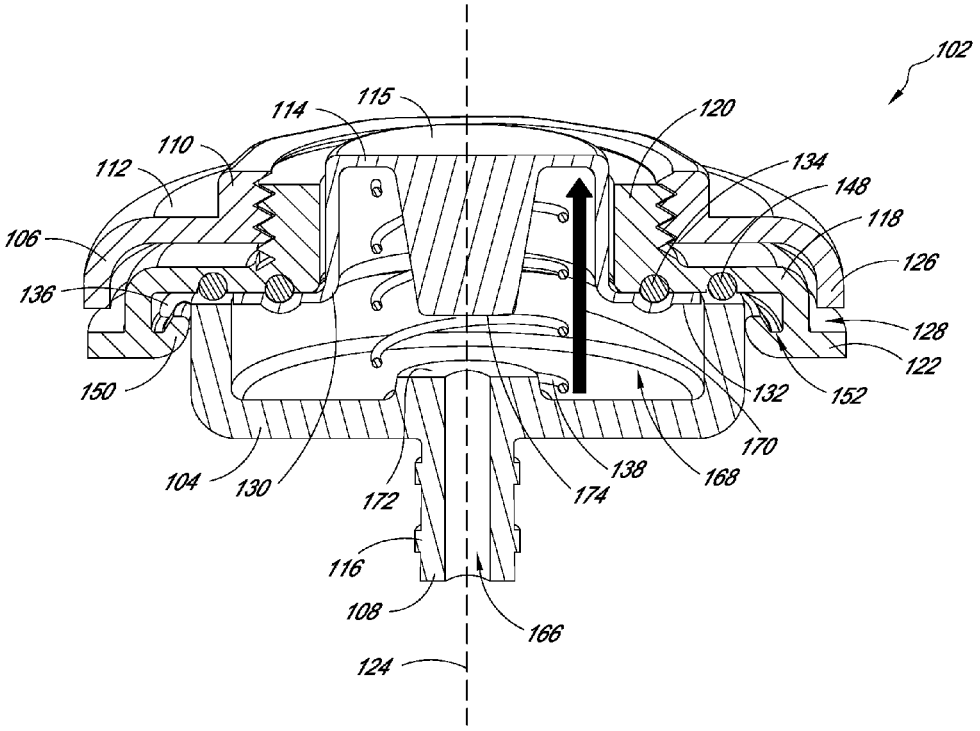
FIG. 21 illustrates a cross-sectional perspective view of an embodiment of a valve.
Figure 22:
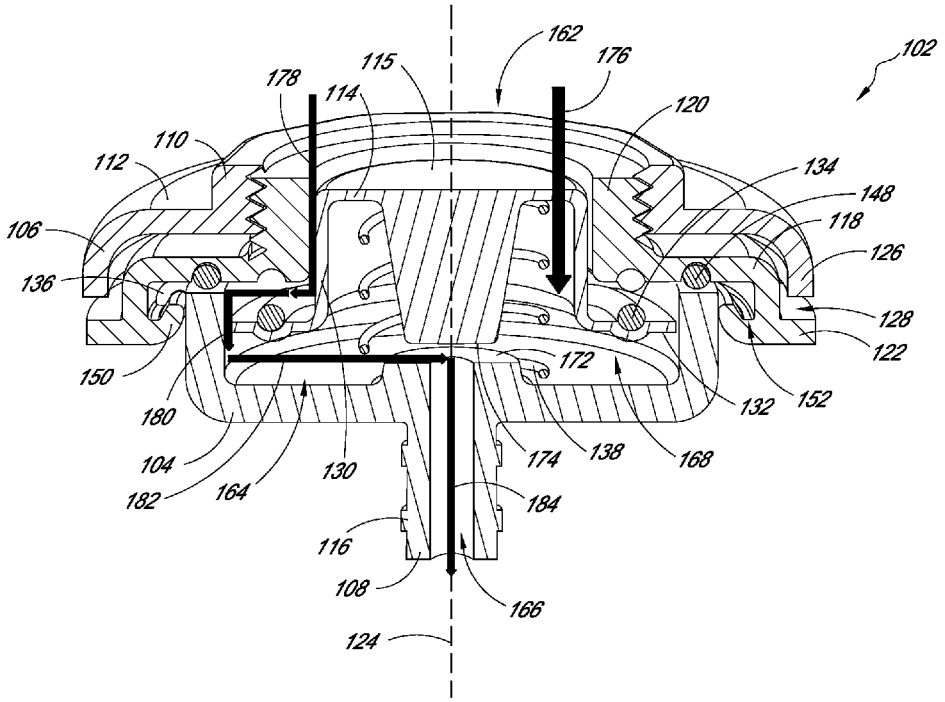
FIG. 22 illustrates a cross-sectional perspective view of an embodiment of a valve with a moved plug.

With continued reference to FIG. 19, the cap 106 can form a cap cavity 156 which can be sized to at least partially receive and/or enclose the hub 118 and/or bottom 104 (including the plug 130) (see, for example, FIGS. 20-22). The cap 106 can have a cap opening 158 (e.g., through the cap boss 110) to receive the hub boss 120 and/or allow/direct fluid flow through the cap opening 158 as discussed herein. The hub 118 can form a hub cavity 160 to at least partially receive and/or enclose the bottom 104 and/or the plug 130 (see, for example, FIGS. 20-22). The hub 118 can have a hub opening 162 (e.g., through the hub boss 120) to slidingly receive plug 130 (e.g., the button 114) and/or allow/direct fluid flow through the hub opening 162 as discussed herein. The hub opening 162 can form an hub opening wall to slidingly receive the plug 130 (e.g., the button 114) and/or allow/direct fluid flow through the hub opening 162 as discussed herein. The bottom 104 can have a bottom cavity 164 to at least partially receive and/or enclose the plug 130.

As illustrated in FIG. 19, the bottom 104 can also have a fluid passageway (e.g., conduit, lumen) 166. The fluid passageway 166 can extend along the central axis 124 and into the bottom cavity 164 to provide fluid communication between the nozzle 108 and the bottom cavity 164.

FIG. 20 illustrates a cross-sectional side view of an embodiment of the valve 102. FIG. 21 illustrates a cross-sectional perspective view of an embodiment of the valve 102. As illustrated in FIGS. 20 and 21, when assembled, the protrusion 136 of the bottom 104 can engage the conduit flange 150 of the hub 118. The protrusion 136 can extend radially outwardly or away from the central axis 124 and downwardly (e.g., in the second direction 176, see FIG. 22). The conduit flange 150 can extend radially inwardly or toward the central axis 124 and upwardly (e.g., in the first direction 170, see FIG. 21). The protrusion 136 and conduit flange 150 can have corresponding shapes for the hub conduit 152 to engage the protrusion 136 such that the bottom 104 and the hub 118 are restrained, inhibited, and/or prevented from moving along the central axis 124 (e.g. in the first direction 170 or the second directions 176) relative to teach other and along a plane perpendicular to the central axis 124 relative to each other.

When the bottom 104 and the hub 118 are connected/engaged as discussed herein, the hub gasket 148 is compressed against or contacted by the surfaces of the bottom 104 and the hub 118 (e.g., second gasket channel 146) as discussed herein. The hub gasket 148 can provide a fluid tight seal to form a fluid chamber (e.g., internal chamber) 168 between the bottom 104 and the hub 118. When the spring 138 biases the plug 130 against the hub 118, the plug gasket 134 is compressed against or contacted by the surfaces of the hub 118 and the plug 130 (e.g., the first gasket groove 142 and the plug gasket groove 144). The fluid chamber 168 and/or plug flange 132 can be sized to limit the motion of the plug 130 along the central axis. For example, as the plug 130 is moved along the central axis 124 in the second direction 176 (see FIG. 22), the plug flange 132 can contact a surface of the bottom 104 at a desired and/or predetermined position along the central axis to limit further motion of the plug 130 along the central axis 124.

As illustrated in FIG. 20, the plug flange 132 (e.g., peripheral seal) can circumscribe the spring 138 about the central axis 124. Stated differently, the plug flange 132 can be positioned about the central axis 124 around the spring 138 such that the plug flange 132 and the spring 138 lie in a same plane perpendicular to the central axis 124. The plug flange 132 can circumscribe the spring 138 about the central axis throughout the range of motion of the plug 130 as discussed herein. Stated differently, in some embodiments, the plug flange 132 circumscribes the spring 138 about the central axis 124 regardless of the position of the plug 130 along the central axis 124 (e.g., the plug flange 132 and the spring 138 lie in the same plane perpendicular to the central axis 124). In some embodiments, the plug flange 130 and the spring 130 can be arranged such that the plug flange 132 and the spring 138 do not lie in a same plane perpendicular to the central axis 124 when either plug flange 130 is biased against the hub 118 or the plug flange 130 is moved along the central axis 124 as discussed herein.

As illustrated in FIG. 20, the plug 130 can be in a shape of, for example, a hat. For example, the button 114 (e.g., actuator) can be connected to the plug flange 132 via a plug wall (e.g., actuator wall) 165 between the button 114 and the plug flange 132. The plug flange 132 can extend radially outward from the central axis 124 to form a shape of, for example, a hat. When the spring 132 is positioned in a plug cavity 167 of the plug 130 formed by the button 114 and the plug wall 165, the plug flange 132 connected to the plug wall 165 can circumscribe the spring 138 as discussed herein.

As illustrated in FIG. 21, the spring 138 biases the plug 130 in a first direction 170 along the central axis 124. The spring 138 biases the plug against the hub 118 as discussed herein. In some embodiments, the spring 138 and/or a resilient element/member may bias the plug 130 against other components of the valve 102. Upon formation of the fluid tight seal with compression, pressure on, and/or contact with the plug gasket 134 and the hub gasket 148, the fluid chamber 168 may be not in fluid communication with other components and/or openings of the valve 102 except for the fluid passageway 166. When the nozzle 108 is in fluid communication with an adjustable cushion 4 and/or an airtight envelope 44 (via, for example, a tube 46), fluid is inhibited from flowing through the valve 102 and correspondingly, the adjustable cushion 4 and/or airtight envelope 44. Stated differently, upon formation of the fluid tight seals with compression, pressure on, and/or contact the plug gasket 134 and the hub gasket 148, the fluid chamber 168 remains in fluid communication with the fluid passageway 166 while the valve 102 inhibits and/or prevents other types of fluid communication with the fluid chamber 166 to control fluid flow through the valve 102 and any attachment (e.g., airtight envelope 44) to the nozzle 108.

With continued reference to FIG. 21, the bottom 104 (e.g., a base of the bottom 104) can have a bottom boss 172 (e.g., a lower surface boss). The fluid passageway 166 can pass through the bottom boss 172 to provide fluid communication with the fluid chamber 168 as discussed herein. The bottom boss 172 can be centered on the central axis 124. The bottom boss 172 can protrude or rise from the bottom 104 to provide a feature upon which or about which the spring 138 can be positioned (e.g., circumscribe the bottom boss 172) in a desired and/or predetermined position in the valve 102 (e.g., fluid chamber 168).

As illustrated in FIG. 21, the spring 138 and the bottom boss 172 can be concentric or substantially concentric and centered on the central axis 124. The spring 138 can have a larger internal diameter relative to a smaller external diameter of the bottom boss 172. In some embodiments, the spring 138 can have an internal diameter that is substantially the same length or dimension as an external diameter of the bottom boss 172. In some embodiments, the bottom boss 172 can be substantially coned shaped with the external diameter decreasing in the first direction 170 (e.g. a thimble shape). At a desired and/or predetermined position, the spring 138 can have an internal diameter that is substantially the same length or dimension as the external diameter of the bottom boss 172 such that the spring 138 rests primarily on the bottom boss 172 without or substantially without contacting a surface of the bottom 104 when positioned in the fluid chamber 168. Accordingly, the spring 138 can rest on and/or be positioned around the bottom boss 172 against a surface of the bottom 104 (e.g., lower surface of the fluid chamber 168) and/or against a surface of the bottom boss 172 for the spring 138 to bias the plug 130 in a desired direction (e.g., the first direction 170) as discussed herein.

With continued reference to FIG. 21, the plug 130 can have a plug boss 174 (e.g., an upper surface boss). As illustrated in FIG. 21, the plug boss 174 can protrude or rise from the button 114 of the plug 130 to provide a feature upon which or about which the spring 138 can be positioned (e.g., circumscribe the plug boss 174) in a desired and/or predetermined position in the valve 102 (e.g., fluid chamber 168). The plug boss 174 can be centered on the central axis 124.

The spring 138 and the plug boss 174 can be concentric or substantially concentric and centered on the central axis 124. The spring 138 can have a larger internal diameter relative to a smaller external diameter of the plug boss 174. In some embodiment, the spring 138 can have an internal diameter that is substantially the same length or dimension as an external diameter of the plug boss 174. As illustrated in FIG. 21, the plug boss 174 can be substantially coned shaped (e.g., thimble shaped) with the external diameter decreasing in the second direction 176 (see FIG. 22). At a desired and/or predetermined position, the spring 138 can have an internal diameter that is substantially the same length or dimension as the external diameter of the plug boss 174 such that the spring 138 rests primarily on plug boss 174 without or substantially without contacting a surface of the plug 130 and/or button 114 when positioned in the fluid chamber 168. Accordingly, the spring 138 can rest on and/or be positioned around the plug boss 174 against a surface of the plug 130 (e.g., upper surface of the fluid chamber 168) and/or against a surface of the plug boss 174 for the spring to bias the plug 130 in a desired direction (e.g., the first direction 170) as discussed herein.

FIG. 22 illustrates a cross-sectional perspective view of an embodiment of the valve 102 with the plug 130 moved. As discussed herein, the plug 130 can be moved and/or depressed (e.g., downwardly) relative to, for example, the hub 118. As illustrated in FIG. 22, the plug 130 can be moved in a second direction 176 along the central axis 124 by, for example, depressing the button 114 (e.g., actuator) in the second direction 176.

As discussed herein, the hub opening 162 can be sized to receive and at least partially enclose the plug 130 (e.g., button 114). The internal diameter of the hub opening 162 can be relatively larger than the external diameter of the plug 130 (e.g., at the button 114) for the plug 130 to be slidingly received and/or engaged. The internal diameter of the hub opening 162 can be sized relative to the external diameter of the plug 130 (e.g., button 114) to provide sufficient sliding clearance to allow/permit the plug 130 to slidingly move in the hub opening 162 while simultaneously, guiding the plug 130 substantially along the central axis 124. Sufficient clearance between the hub opening 162 and the plug 130 can permit/allow fluid flow (e.g., airflow) around the plug 130 and through hub opening 162 into the fluid chamber 168 as discussed herein.

As discussed herein, the bottom cavity 164 of the bottom 104 can be sized to receive and at least partially enclose the plug 130 (e.g., plug flange 132). The internal diameter of the bottom cavity 164 can be relatively larger than an external diameter of the plug 130 (e.g., at the flange 132) for the plug 130 to be slidingly received and/or engaged. The internal diameter of the bottom cavity 164 can be sized relative to the external diameter of the plug 130 (e.g., flange 132) to provide sufficient sliding clearance to allow/permit the plug 130 to slidingly move in the bottom cavity 164 while simultaneously, guiding the plug 130 substantially along the central axis 124. Sufficient clearance between the bottom cavity 164 and the plug 130 can permit/allow fluid flow (e.g., airflow) around the plug 130 and through bottom cavity 164 into the fluid chamber 168 and/or fluid passageway 166 as discussed herein. In some embodiments, the hub cavity 160 of the hub 118 can slidingly receive and/or engage the plug 130 (e.g., plug flange 132) as discussed in reference to the bottom cavity 164 when, for example, the hub 118 extends further along the second direction 176 and is proximate to the plug 130 in some embodiments of the valve 172.

As illustrated in FIG. 22 and discussed herein, the plug 130 can be positioned in the valve 102 in a desired and/or predetermined position and can be slid along the central axis 124 without a spindle, axle, plug retainer, columns, and/or other supports. The spring 138 can suspend the plug in the desired and/or predetermined position in the fluid chamber 168 against the hub 118 without a spindle, axle, plug retainer, columns, and/or other guides or supports. As discussed herein, the plug 130 can move along the central axis 124 without a spindle, axle, plug retainer, columns, and/or other guides or supports. A range of motion of the plug 130 along the central axis 124 in the first direction 170 can be limited by, for example, the hub 118 as discussed herein (e.g., compression or application of force against the plug gasket 134). The range of motion of the plug 130 along the central axis in the second direction 176 can be limited by the bottom 104 (e.g., bottom boss 174) when the plug is depressed/moved along the central axis in the second direction 176. For example, the plug 130 can be stopped when the plug boss 174 comes against or abuts the bottom 104 (e.g., bottom boss 174).

The dimensions of the bottom boss 172 and the plug boss 174 can be varied along the central axis 124 to achieve a desired range of motion of the plug 130 along the central axis 124 as well as positioning of the spring 138 along the central axis 124. For example, in some embodiments, the valve 102 may not have a bottom boss 172. The plug boss 174 may extend along the central axis 124 to allow a desired range of motion of the plug 130 along the central axis 124. For example, movement of the plug 130 may be stopped when the plug boss 174 comes against or abuts a surface of the bottom 104 (e.g., lower surface of the fluid chamber 168) as the button 114 is depressed. As another example, in some embodiments, the valve 102 may not have a plug boss 174. The bottom boss 172 may extend along the central axis 124 to allow a desired range of motion of the plug 130 along the central axis 124. For example, movement of the plug 130 may be stopped when the bottom boss 172 comes against or abuts a surface of the plug 130 (e.g., upper surface of the fluid chamber 168) as the button 114 is depressed.

The dimensions of the bottom boss 172 and the plug boss 174 may be correspondingly varied along the central axis to achieve a desired range of motion of the plug 130 along the central axis 124 as discussed herein. For example, while the plug boss 174 is illustrated in FIG. 22 to be longer along the central axis 124 relative to the bottom boss 172, in some embodiments, the bottom boss 172 can be longer along the central axis 124 relative to the plug boss 174.

In some embodiments, resistance against further compression of the spring 138 can substantially stop the plug 130 as the button 114 is depressed at a position along the central axis 124 before the plug boss 174 comes against or abuts the bottom 104 (e.g., bottom boss 174). Accordingly, the plug 130 can be slidingly guided to move along the central axis 124 within a desired and/or predetermined range of motion within the fluid chamber 168 without a spindle, axle, and/or plug retainer, columns, and/or other guides or supports. In some embodiments, however, the plug 130 can be connected to a spindle, axle, and/or plug retainer, columns, and/or other guides or supports that, for example, extend(s) through the fluid passageway 166 while still allowing fluid communication through the fluid passageway 166.

When the plug 130 is depressed away from the hub 118, fluid flow (e.g., airflow) can pass through the valve 102 by, for example, the plug flange 132 moving away from a surface of the hub 118. Referring to FIG. 22, a first fluid flow path 178, a second fluid flow path 180, a third fluid flow path 182, and a fourth fluid flow path 184 show an example flow path of fluid through the valve 102 generally along the second direction 176 (e.g., as an airtight envelope 44 inflates) when the plug 130 is depressed along the second direction 176 as discussed herein. Fluid flow can first enter and pass/flow through the hub opening 162 by the plug 130 (e.g., button 114) as indicated by first fluid flow path 178 (e.g., along the central axis 124 into the hub cavity 160, bottom cavity 164, and/or fluid chamber 168). Thereafter, the fluid flow can proceed to pass/flow by plug flange 132 and/or plug gasket 134 as indicated by second fluid flow path 180 (e.g., radially outward/away from and then along the central axis 124 in the hub cavity 160, bottom cavity 164, and/or fluid chamber 168). Thereafter, the fluid flow can proceed to pass/flow by the plug flange 132 and/or plug gasket groove 144 back toward the central axis 124 after flowing around the plug flange 132 as indicated by third fluid flow path 182 (e.g., radially inward/toward along the central axis 124 in the hub cavity 160, bottom cavity 164, and/or fluid chamber 168). Thereafter, the fluid flow can proceed to pass/flow by the spring 138, bottom boss 172, and/or plug boss 174 into the fluid passageway 166 of the nozzle 108 as indicated by the third fluid flow path 182 (e.g., radially inward/toward along the central axis 124 in the hub cavity 160, bottom cavity 164, and/or fluid chamber 168) and then by the fourth fluid flow path 184 (e.g., along the central axis 124 out of the hub cavity 160, bottom cavity 164, and/or fluid chamber 168). Fluid flow that flows generally along the first direction 170 can pass the same components of the valve 102 as discussed herein in the opposite direction.

Figure 23:
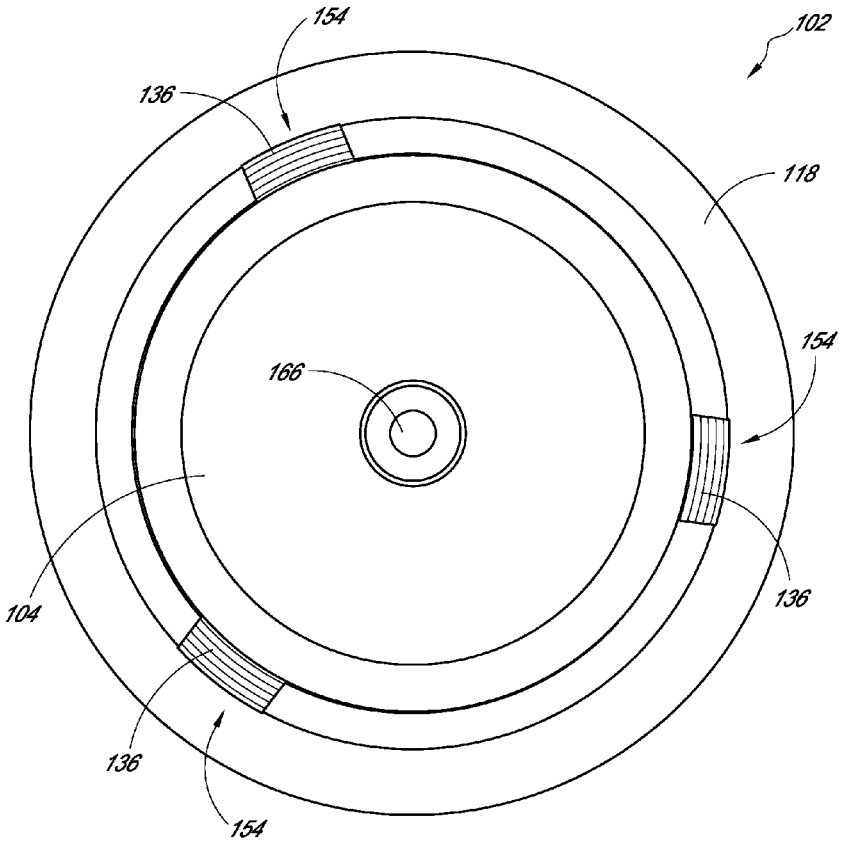
FIG. 23 illustrates bottom view of an embodiment of a valve.

FIG. 23 illustrates bottom view of an embodiment of the valve 102. The valve 102 can have cutouts 154 that provide sliding entry for projections 136 of the bottom 104 into the hub conduit 152 as discussed herein. The hub 118 can have the cutouts 154 positioned in the conduit flange 150 to allow access by the projections 136 into the hub conduit 152 as discussed herein. As illustrated in FIG. 22, the valve 102 can have three projections 136 and correspondingly three cutouts 154. In some embodiments, any number of projections 136 and cutouts 154 can be used, including 2, 3, 4, 5, 6, 7, 8 cutouts 154.

FIGS. 24A-C illustrate an example assembly method for the valve 102. The plug 130 can be positioned in the hub 118 (e.g., hub opening 162) as discussed herein (e.g., along assembly direction 186). The assembly direction 186 can correspond to the first direction 170. Next, the spring 138 can be positioned against the plug 130 (e.g., around the plug boss 174) as discussed herein (e.g., along assembly direction 186). Next, as illustrated in FIG. 24A, the bottom 104 can be positioned against the hub 118 (e.g., along assembly direction 186). The cutouts 154 can receive the projection 136 slidingly therehrough into the hub conduit 152. Next, as illustrated in FIG. 22B, the bottom 104 can be rotated relative to the hub 118 along rotation direction 188 with the projections 136 remaining engaged with the hub conduit 152 while the projections 136 slidingly move in the hub conduit 152 about the central axis 124. The bottom 104 can also be rotated in the opposite direction of rotation direction 188. The bottom 104 and/or hub 118 can be rotated relative to each other about the central axis 124. As illustrated in FIG. 24C, once the projections 136 have cleared the cutouts 154 and the conduit 152 engages the projections 136, the bottom 104 and hub 118 are securely engaged as discussed herein.

After assembly of the bottom 104 and the hub 118 with as discussed herein, the bottom 104 and the hub 118 can be inserted into an opening 42 of a casing 40 of an adjustable cushion 4 with the nozzle 108 connected to, for example, a tube 46. The hub flange 122 can be inserted under the material or internally into the casing 40. The cap 106 can be connected (e.g., tightened) onto the hub 118 as discussed herein to form a channel 128 that securely holds (e.g., engages, mates, clamps) the material of the casing 40 to position the valve 102 at a desired and/or predetermined position in the adjustable cushion 4.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. Seating with at least one adjustable cushion, the seating comprising:

a backrest comprising a backrest frame and a backrest sling fabric, the backrest frame having a left side and a right side opposite the left side, the backrest sling fabric having a left side and a right side opposite the left side, the backrest sling fabric supported at the left and right sides of the backrest sling fabric by the left and right sides of the backrest frame, respectively, suspending the backrest sling fabric between the left and right sides of the backrest frame;

a seat connected to the backrest, the seat comprising a seat frame and a seat sling fabric, the seat frame having a left side and a right side opposite the left side, the seat sling fabric having a left side and a right side opposite the left side, the seat sling fabric supported at the left and right sides of the seat sling fabric by the left and right sides of the seat frame, respectively, suspending the seat sling fabric between the left and right sides of the seat frame;

at least one adjustable cushion on at least one of the backrest sling fabric or the seat sling fabric, the adjustable cushion comprising an airtight envelope, compressible foam inside the envelope, support foam outside the envelope, and a substantially rigid backing member, the airtight envelope comprising at least one port providing fluid communication to an interior of the envelope, wherein the backing member rests against the backrest sling fabric or the seat sling fabric, the support foam rests against the backing member, and the airtight envelope rests against the support foam, and wherein the backing member biases the support foam away from the backrest sling fabric or the seat sling fabric, and the support foam biases the compressible foam away from the backrest sling fabric or the seat sling fabric; and a valve in fluid communication with the port of the envelope, the valve configured to selectively allow ambient air to pass into and out of the airtight envelope, via the port, through the valve, wherein firmness of the adjustable cushion is decreased by opening the valve to allow air to flow out of the airtight envelope and the compressible foam as the compressible foam compresses within the airtight envelope when external pressure is applied to the airtight envelope, and wherein firmness of the adjustable cushion is increased by opening the valve to allow ambient air to flow into the airtight envelope and the compressible foam when the compressible foam is in a compressed state and expands within the airtight envelope while ambient air flows into the airtight envelope.

2. The seating of claim 1, wherein the at least one adjustable cushion is on the backrest sling fabric.

3. The seating of claim 1, wherein the at least one adjustable cushion is positioned in at least one of a lumbar region of the backrest or a head region of the backrest.

4. The seating of claim 3, wherein a first adjustable cushion is positioned in the lumbar region and a second adjustable cushion is positioned in the head region.

5. The seating of claim 1, wherein the at least one adjustable cushion is on the seat sling fabric.

6. The seating of claim 1, wherein the backing member comprises a flat panel having about same dimensions as the adjustable cushion to generally maintain a flat shape of the backrest sling fabric or the seat sling fabric as the firmness of the adjustable cushion is changed.

7. The seating of claim 1, further comprising at least one non-adjustable cushion on at least one of the backrest sling fabric or the seat sling fabric, wherein substantially an entire seating area defined by the backrest and the seat is generally defined by at least one of the adjustable cushion or the non-adjustable cushion.

8. The seating of claim 1, wherein the backing member is not connected to or resting on the backrest frame or the seat frame of the seating.

9. The seating of claim 1, wherein the at least one adjustable cushion includes a first adjustable cushion and a second adjustable cushion, the first adjustable cushion positioned in a top region of the backrest, and the second adjustable cushion positioned in a bottom region of the backrest.

10. The seating of claim 9, wherein the seating further comprises at least one non-adjustable cushion positioned in a middle region of the backrest, wherein the middle region is between the top and bottom regions of the backrest.

11. The seating of claim 10, wherein the first adjustable cushion, the second adjustable cushion, and the non-adjustable cushion substantially cover an entire back area defined by the backrest of the seating.

12. The seating of claim 1, wherein the adjustable cushion is on the seat sling fabric and positioned against a side of a leg of an occupant to directionally support and bias the leg along a length of the seat.

* * * * *